US012059770B2

(12) United States Patent
Kuroki

(10) Patent No.: US 12,059,770 B2
(45) Date of Patent: Aug. 13, 2024

(54) WASHING DEVICE AND BARREL POLISHING SYSTEM

(71) Applicant: SINTOKOGIO, LTD., Nagoya (JP)

(72) Inventor: Tetsuya Kuroki, Aichi (JP)

(73) Assignee: SINTOKOGIO, LTD., Nagoya (JP)

( * ) Notice: Subject to any disclaimer, the term of this patent is extended or adjusted under 35 U.S.C. 154(b) by 1002 days.

(21) Appl. No.: 16/981,304

(22) PCT Filed: Mar. 15, 2019

(86) PCT No.: PCT/JP2019/010983
§ 371 (c)(1),
(2) Date: Sep. 16, 2020

(87) PCT Pub. No.: WO2019/181811
PCT Pub. Date: Sep. 26, 2019

(65) Prior Publication Data

US 2021/0114168 A1 Apr. 22, 2021

(30) Foreign Application Priority Data

Mar. 23, 2018 (JP) ..... 2018-056510

(51) Int. Cl.
*B24B 31/02* (2006.01)
*B24B 27/00* (2006.01)
(Continued)

(52) U.S. Cl.
CPC ..... *B24B 55/06* (2013.01); *B24B 31/02* (2013.01); *B24B 41/02* (2013.01);
(Continued)

(58) Field of Classification Search
CPC ..... B24B 55/06; B24B 31/02; B24B 31/12; B24B 41/02; B24B 41/005; B24B 27/0015; B24B 31/16
(Continued)

(56) References Cited

U.S. PATENT DOCUMENTS 4,727,684 A * 3/1988 Kobayashi ..... B24B 31/02 241/137
4,949,510 A * 8/1990 Kobayashi ..... B24B 31/037 451/6
(Continued)

FOREIGN PATENT DOCUMENTS

JP S55-010307 B1 3/1980
JP S59-19255 U 2/1984
(Continued)

OTHER PUBLICATIONS

International Preliminary Report on Patentability mailed Oct. 8, 2020 for PCT/JP2019/010983.

*Primary Examiner* — Laura C Guidotti
*Assistant Examiner* — Caleb Andrew Holizna
(74) *Attorney, Agent, or Firm* — Faegre Drinker Biddle & Reath LLP

(57) ABSTRACT

According to an aspect of the present disclosure, there is provided a washing device that washes a barrel tank of a horizontal centrifugal barrel polishing device. The washing device includes a casing, a rotation mechanism, a washing nozzle, and a nozzle moving mechanism. The casing includes a frame to accommodate the barrel tank, and a rotary shaft extending from the frame. The rotation mechanism is a mechanism to rotate the frame around the rotary shaft. The washing nozzle is a nozzle to eject washing water. The washing nozzle is configured to be insertable into and removable from the barrel tank. The nozzle moving mechanism moves the washing nozzle in a direction where the washing nozzle is inserted into and removed from the barrel tank.

10 Claims, 11 Drawing Sheets

(51) Int. Cl.

| | |
|---|---|
| ***B24B 31/12*** | (2006.01) |
| ***B24B 41/00*** | (2006.01) |
| ***B24B 41/02*** | (2006.01) |
| ***B24B 55/06*** | (2006.01) |

(52) U.S. Cl.
CPC ..... *B24B 27/0015* (2013.01); *B24B 31/12* (2013.01); *B24B 41/005* (2013.01)

(58) Field of Classification Search
USPC ..... 451/329
See application file for complete search history.

(56) References Cited

U.S. PATENT DOCUMENTS

| | | | | | |
|---|---|---|---|---|---|
| 5,531,637 | A | | 7/1996 | Kimura | |
| 6,125,864 | A | * | 10/2000 | Morikawa | B08B 9/0826 134/198 |
| 2016/0176008 | A1 | * | 6/2016 | Maeda | B24B 57/02 451/326 |
| 2017/0259393 | A1 | * | 9/2017 | Kobayashi | B08B 7/02 |

FOREIGN PATENT DOCUMENTS

| | | | | | |
|---|---|---|---|---|---|
| JP | H01-177968 | A | | 7/1989 | |
| JP | 2002-254290 | A | | 9/2002 | |
| JP | 2002254290 | A | * | 9/2002 | |
| JP | 2003-041399 | A | | 2/2003 | |
| JP | 2008-036778 | A | | 2/2008 | |
| JP | 2012-152872 | A | | 8/2012 | |
| JP | 5462907 | B2 | | 4/2014 | |
| JP | 5949907 | B2 | * | 7/2016 | B24B 31/033 |
| TW | 315327 | B | | 9/1997 | |
| TW | M266989 | U | | 6/2005 | |
| TW | 2016-03903 | A | | 2/2016 | |
| WO | WO-2013/161093 | A1 | | 10/2013 | |

* cited by examiner (A)

(B)

WASHING DEVICE AND BARREL POLISHING SYSTEM

TECHNICAL FIELD

The present disclosure relates to a washing device and a barrel polishing system.

BACKGROUND ART

A centrifugal barrel polishing device is widely used which causes a barrel tank, which is charged with a mass, to make a planetary motion to thereby polish a workpiece. A horizontal centrifugal barrel polishing device and a vertical centrifugal barrel polishing device are known as the centrifugal barrel polishing device. The horizontal centrifugal barrel polishing device includes a revolution shaft and a rotation shaft that extend in a horizontal direction, and causes a barrel tank to revolve around the revolution shaft while causing the barrel tank to rotate around the rotation shaft, to thereby polish a workpiece in the barrel tank. The vertical centrifugal barrel polishing device includes a revolution shaft and a rotation shaft that extend in a vertical direction, and causes a barrel tank to revolve around the revolution shaft while causing the barrel tank to rotate around the rotation shaft, to thereby polish a workpiece in the barrel tank.

In the processing of a workpiece using the centrifugal barrel polishing device, a series of processes including barrel polishing and a washing process are performed. Generally, in the series of processes, operations such as charging a mass into a barrel tank, attaching and detaching a barrel tank to and from the centrifugal barrel polishing device, and washing a barrel tank are manually performed by an operator. A device disclosed in Patent Literature 1 is known as a technique of automating these operations. Patent Literature 1 discloses a barrel polishing system including a vertical centrifugal barrel polishing device, a dryer that dries a workpiece, a washing device that washes the workpiece, a sorting-vibration sorter that sorts the workpiece and a medium, a fixed amount-of-medium supply device that supplies the medium into the barrel tank, a barrel lid attachment and detachment device that attaches and detaches a lid of the barrel tank, and a robot that transfers the barrel tank between the devices.

CITATION LIST

Patent Literature

Patent Literature 1: Japanese Unexamined Patent Publication No. 2002-254290

SUMMARY OF INVENTION

Technical Problem

In the device disclosed in Patent Literature 1, the barrel tank is transferred between the devices using the robot; and thereby, operations such as charging the medium and washing the workpiece are automated and the efficiency of a series of processes is improved. However, the horizontal centrifugal barrel machine has structural limitations on a method for detaching or washing the barrel tank, and it is difficult to apply the technique of Patent Literature 1 to the horizontal centrifugal barrel polishing device. On the other hand, since the horizontal centrifugal barrel polishing device has a higher abrasive force than the vertical barrel polishing device, it is desirable to perform barrel polishing using the horizontal centrifugal barrel polishing device.

Therefore, there is a need to provide a washing device and a barrel polishing system that can improve the efficiency of a series of processes including barrel polishing and a washing process using a horizontal centrifugal barrel polishing device.

Solution to Problem

According to an aspect of the present disclosure, there is provided a washing device that washes a barrel tank of a horizontal centrifugal barrel polishing device. The washing device includes a casing, a rotation mechanism, a washing nozzle, and a nozzle moving mechanism. The casing includes a frame to accommodate the barrel tank, and a rotary shaft extending from the frame. The rotation mechanism is a mechanism to rotate the frame around the rotary shaft. The washing nozzle is a nozzle to eject washing water. The washing nozzle is configured to be insertable into and removable from the barrel tank. The nozzle moving mechanism moves the washing nozzle in a direction where the washing nozzle is inserted into and removed from the barrel tank.

In the washing device according to the aspect, the washing water is ejected from the washing nozzle that is insertable into and removable from the barrel tank, so that a washing liquid is supplied into the barrel tank. When the frame is rotated around the rotary shaft by the rotation mechanism, the washing liquid supplied into the barrel tank flows in the barrel tank. Accordingly, the washing of a mass in the barrel tank is promoted. According to the washing device, it is possible to automate the washing of the barrel tank which is performed in a subsequent step of barrel polishing; and thereby, it is possible to improve the efficiency of a series of processes including barrel polishing and a washing process.

The washing device of one embodiment may further include a first screen having an opening through which a polishing medium is passable and a workpiece is not passable; and a screen moving mechanism to move the first screen between a position where the first screen covers an opening portion of the barrel tank and a position where the first screen is separated from the opening portion.

Since the first screen has the opening through which the polishing medium is passable and the workpiece is not passable, it is possible to sort the polishing medium and the workpiece by discharging the contents of the barrel tank in a state where the first screen is disposed at the position where the first screen covers the opening portion of the barrel tank.

The washing device of one embodiment may further include a second screen having an opening through which the workpiece and the polishing medium are not passable. The nozzle moving mechanism may move the second screen between a position where the second screen covers the opening portion of the barrel tank and a position where the second screen is separated from the opening portion.

Since the second screen has the opening through which the workpiece and the polishing medium are not passable, while allowing the workpiece and the polishing medium to remain in the barrel tank, it is possible to discharge the washing liquid and the like from the barrel tank by tilting the barrel tank in a state where the second screen is disposed at the position where the second screen covers the opening portion of the barrel tank.

In one embodiment, the washing nozzle may be configured to supply water and a compound into the barrel tank. In the embodiment, since the water and the compound are supplied into the barrel tank after the barrel tank is washed, the barrel tank after washing can be used in barrel polishing again.

According to an aspect of the present disclosure, there is provided a barrel polishing system including: a horizontal centrifugal barrel polishing device; a barrel tank attachment and detachment device to attach and detach a barrel tank to and from the centrifugal barrel polishing device; the above-described washing device; an charging device to charge a mass into the barrel tank; and a transport device that transports the barrel tank between the devices (the centrifugal barrel polishing device, the barrel tank attachment and detachment device, the washing device, and the charging device).

The barrel polishing system according to the aspect includes the centrifugal barrel polishing device, the barrel tank attachment and detachment device, the washing device, and the charging device. Then, the transport of the barrel tank between these devices is performed by the transport device. For this reason, it is possible to automate operations such as charging the mass into the barrel tank, attaching and detaching the barrel tank to and from the centrifugal barrel polishing device, and washing the barrel tank. Therefore, it is possible to improve the efficiency of a series of processes including barrel polishing and the washing process.

In one embodiment, the transport device may include a chain conveyor. Since the chain conveyor can be freely designed according to an environment where the barrel polishing system is installed, it is possible to realize the barrel polishing system with good workability.

In one embodiment, the charging device may include a polishing medium supply device to charge a polishing medium into the barrel tank, an abrasive grain supply device to charge abrasive grains into the barrel tank, and a workpiece supply device to charge a workpiece into the barrel tank. In the embodiment, it is possible to supply the polishing medium, the abrasive grains, and the workpiece to the barrel tank at a ratio corresponding to polishing conditions.

In one embodiment, the barrel tank attachment and detachment device may include a hanging tool to hold the barrel tank, an elevating mechanism to move the hanging tool upward and downward, and a moving mechanism to move the hanging tool. The barrel tank attachment and detachment device may further include a clamp mechanism to lock the barrel tank to the centrifugal barrel polishing device or release locking of the barrel tank to the centrifugal barrel polishing device. The barrel tank attachment and detachment device can attach and detach the barrel tank to and from the centrifugal barrel polishing device.

The barrel polishing system of one embodiment may further include a lid attachment and detachment device that attaches and detaches a barrel tank lid to and from a barrel tank body of the barrel tank. The lid attachment and detachment device includes a hanging tool to hold the barrel tank lid, an elevating mechanism to move the hanging tool upward and downward, a moving mechanism to move the hanging tool, and a clamp mechanism to fix the barrel tank lid to the barrel tank body or release fixing of the barrel tank body and the barrel tank lid. The lid attachment and detachment device can attach and detach the barrel tank lid to and from the barrel tank body.

The barrel polishing system of one embodiment may further include a lid washing device that washes the barrel tank lid. The lid washing device includes a washing nozzle to eject a washing liquid to the barrel tank lid to wash the barrel tank lid, and an air blowing nozzle eject compressed air to the barrel tank lid which is washed. The lid washing device can wash the barrel tank lid.

Advantageous Effects of Invention

According to the aspects and various embodiments of the present invention, it is possible to improve the efficiency of a series of processes including barrel polishing using the horizontal centrifugal barrel polishing device.

BRIEF DESCRIPTION OF DRAWINGS

FIG. 2(A) is a view illustrating the barrel tank to which a lid is not fixed, and FIG. 2(B) is a view illustrating the barrel tank to which the lid is fixed.

FIG. 3(A) is a view illustrating a state where the barrel tank is not fixed to the barrel tank case, and FIG. 3(B) is a view illustrating a state where the barrel tank is fixed to the barrel tank case.

FIG. 4(A) is a front view of the washing device, and FIG. 4(B) is a cross-sectional view of FIG. 4(A) taken along line A-A.

DESCRIPTION OF EMBODIMENTS

Figure 1:
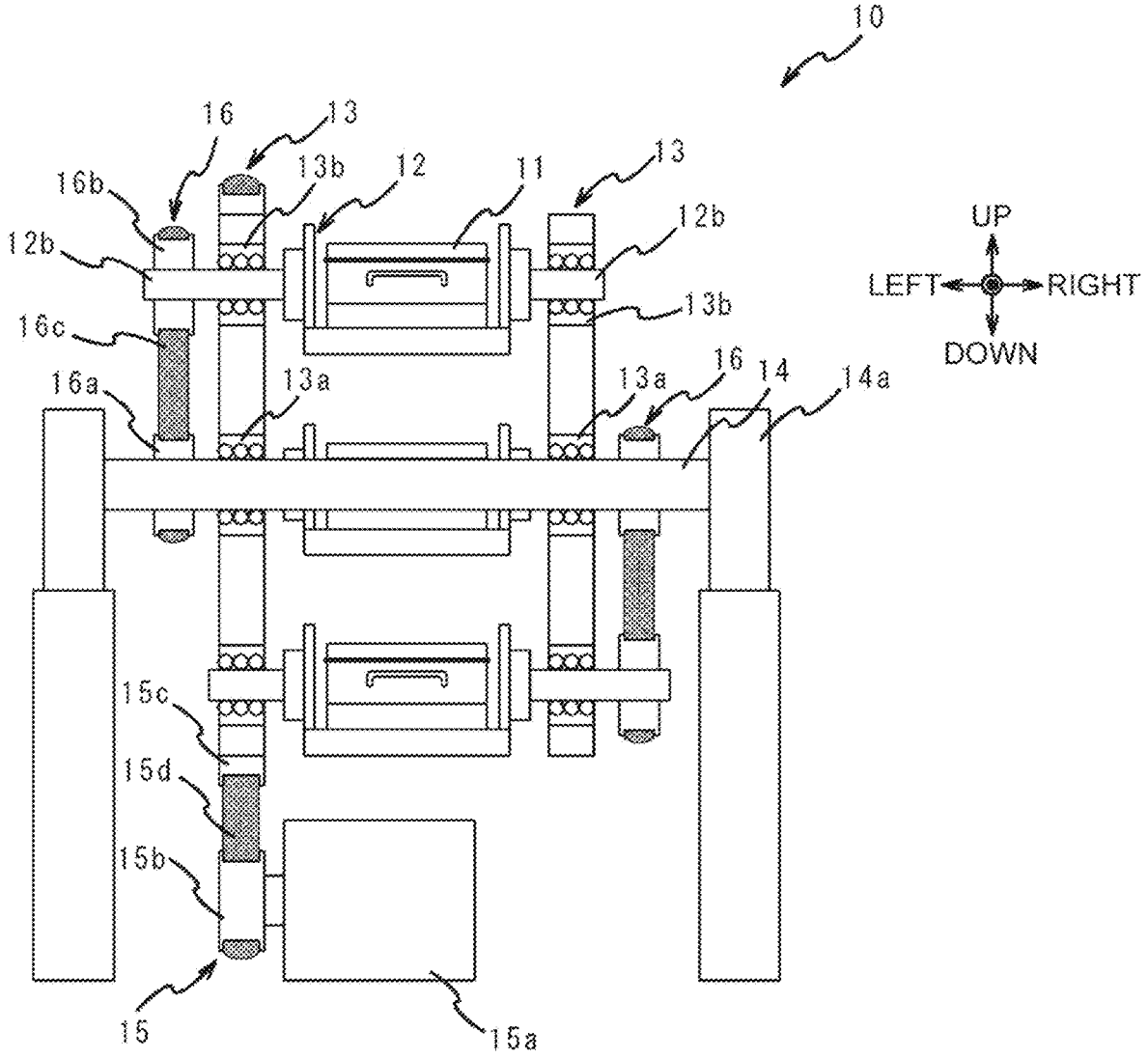
FIG. 1 is a view schematically illustrating a centrifugal barrel polishing device of one embodiment.

Hereinafter, embodiments of the present disclosure will be described with reference to the drawings. Incidentally, in the following description, the same reference signs are assigned to the same or equivalent components and duplicated descriptions will not be repeated. The dimensional ratios in the drawings are not necessarily coincide with those in the description. The terms "up", "down", "right", "left", "front" and "back" in the specification are based on illustrated states and are for convenience.

Figure 5:
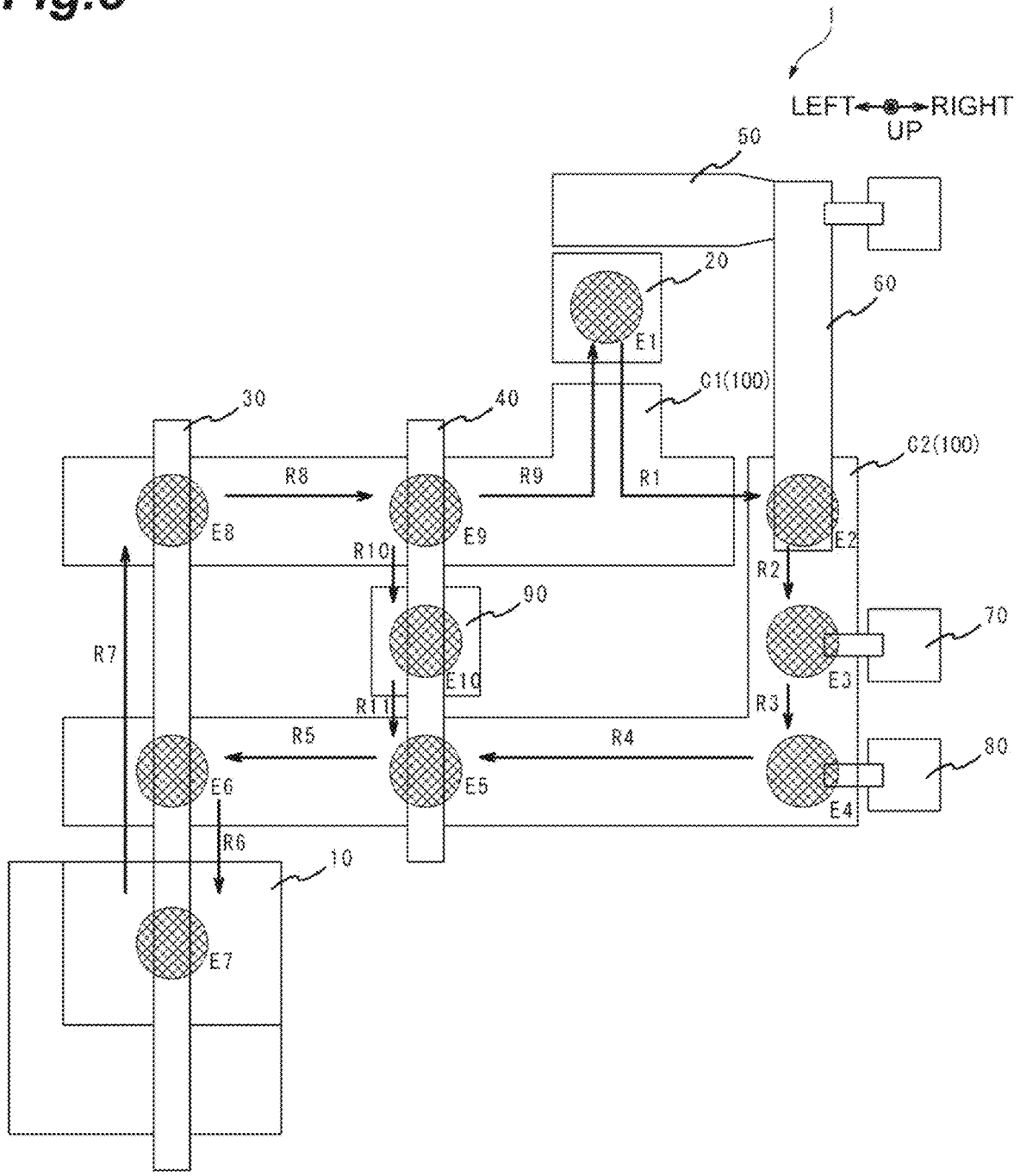
FIG. 5 is a plan view schematically illustrating a barrel polishing system of one embodiment.

A barrel polishing system 1 according to one embodiment includes a barrel polishing device 10, a washing device 20, a barrel tank attachment and detachment device 30, a lid attachment and detachment device 40, a medium supply device (polishing medium supply device) 60, an abrasive grain supply device 70, a workpiece supply device 80, a lid washing device 90, and a transport device 100 (refer to FIG. 5). In the embodiment of FIG. 5, the barrel polishing system 1 includes a first conveyor C1 and a second conveyor C2 as the transport device 100.

FIG. 1 is a front view schematically illustrating the barrel polishing device 10 of one embodiment. The barrel polishing device 10 is a horizontal centrifugal barrel polishing device. Incidentally, the horizontal centrifugal barrel device includes a revolution shaft and a rotation shaft that extends in a horizontal direction, and causes a barrel tank to revolve around the revolution shaft while causing the barrel tank to rotate around the rotation shaft, to thereby polish a workpiece in the barrel tank.

As illustrated in FIG. 1, the barrel polishing device 10 includes a plurality of barrel tanks 11, a plurality of barrel tank cases 12, a pair of turrets 13 (revolution disk), a revolution shaft 14, a drive mechanism 15, and a driven mechanism 16. The barrel tank 11 is charged with a mass including a polishing medium and a workpiece. In one embodiment, the barrel polishing device 10 includes four barrel tanks 11. FIG. 1 illustrates three barrel tanks 11 of the four barrel tanks 11.

Figure 2:
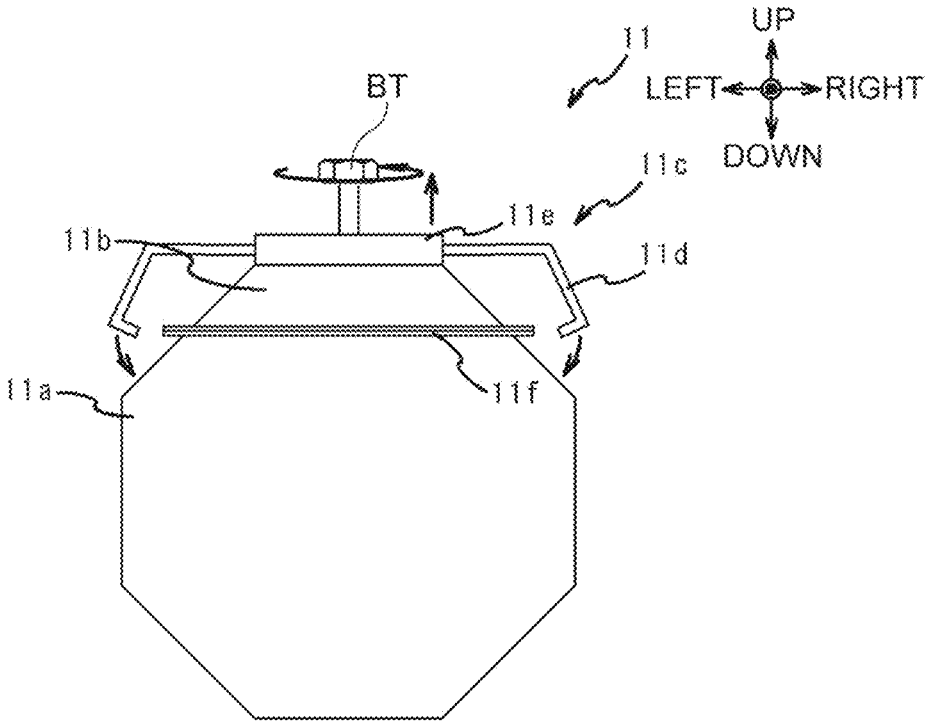
FIG. 2 is a view schematically illustrating a barrel tank.
Figure 2:
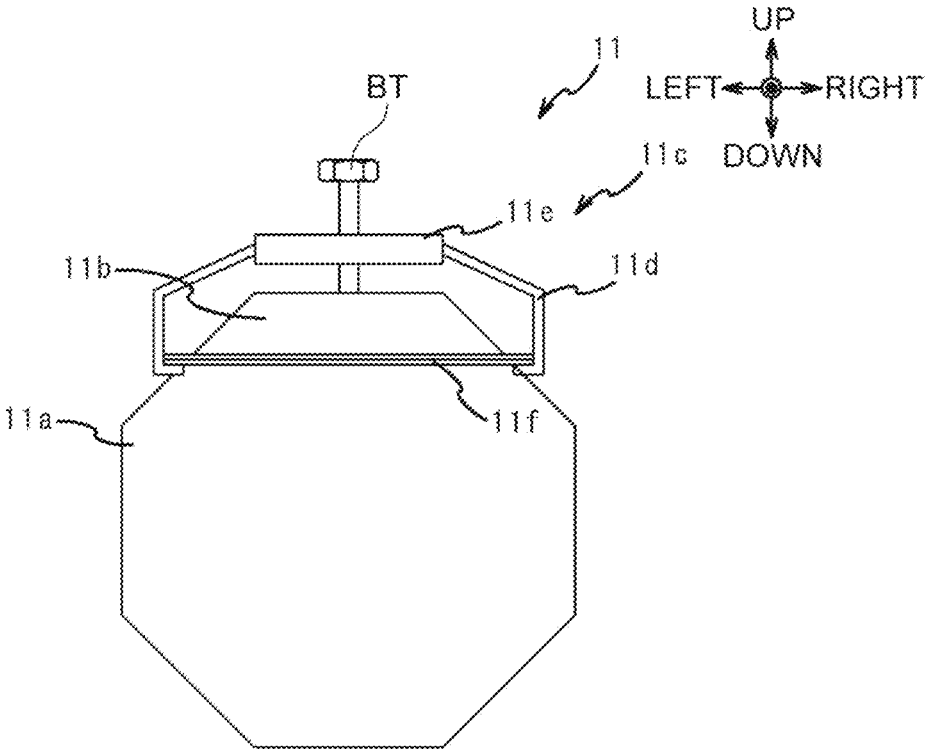

As illustrated in FIGS. 2(A) and 2(B), the barrel tank 11 has a cylindrical shape, and the inside of the barrel tank 11 defines a processing space. The cross-section of the processing space has a polygonal shape (octagonal shape in the embodiment illustrated in FIG. 2). The barrel tank 11 includes a barrel tank body 11*a*, barrel tank lid 11*b*, and a lid fixing mechanism 11*c*. The barrel tank body 11*a* is a container that defines the processing space. An opening portion for charging a mass is formed in an upper portion of the barrel tank body 11*a*. A flange portion 11*f* is provided in the vicinity of the opening portion of the barrel tank body 11*a*. The flange portion 11*f* has a plate shape and projects laterally from the barrel tank body 11*a*.

In one embodiment, a liner may be provided on an inner surface of the barrel tank body 11*a* and a lower surface of the barrel tank lid 11*b*. The liner is made of abrasion-resistant rubber (for example, urethane rubber) and has a function of preventing abrasion of an inner wall surface of the barrel tank body 11*a*.

The barrel tank lid 11*b* is provided to cover the opening portion of the barrel tank body 11*a*, and seals the opening portion to seal the processing space. The lid fixing mechanism 11*c* has a function of fixing the barrel tank lid 11*b* to the barrel tank body 11*a*. The lid fixing mechanism 11*c* includes a lock member 11*d* and a pressing member 11*e*.

The lock member 11*d* is a member that locks the barrel tank lid 11*b* to the barrel tank body 11*a*. The lock member 11*d* has a bar shape of which the tip is bent to be able to lock the flange portion 11*f* of the barrel tank body 11*a*. A base end of the lock member 11*d* is attached to the pressing member 11*e* to be rotatable with respect to the pressing member 11*e*. The lid fixing mechanism 11*c* may include a plurality of the lock members 11*d* so as to improve adhesion between the barrel tank body 11*a* and the barrel tank lid 11*b*. In the embodiment illustrated in FIG. 2, the lid fixing mechanism 11*c* includes two lock members 11*d*.

The pressing member 11*e* is a member that presses the barrel tank lid 11*b* against the barrel tank body 11*a* using the lock member 11*d*. The pressing member 11*e* is attached to the barrel tank lid 11*b* to be movable with respect to the barrel tank lid 11*b* in an upward and downward direction. For example, the pressing member 11*e* has the shape of a plate where a screw hole is formed, and a bolt BT extending in the upward and downward direction is inserted into the screw hole. For example, as illustrated in FIG. 2(A), when the bolt is rotated to raise the pressing member 11*e*, the lock member 11*d* rotates around a rotary shaft attached to the pressing member 11*e*, so that the tip of the lock member 11*d* moves closer to a flange portion 11*f* side of the barrel tank body 11*a*. As illustrated in FIG. 2(B), when the pressing member 11*e* is further raised up, the tip of the lock member 11*d* is locked to the flange portion 11*f*, and as a result, the barrel tank lid 11*b* is pressed against the barrel tank body 11*a*. Accordingly, the barrel tank lid 11*b* is fixed to the barrel tank body 11*a*.

Figure 3:
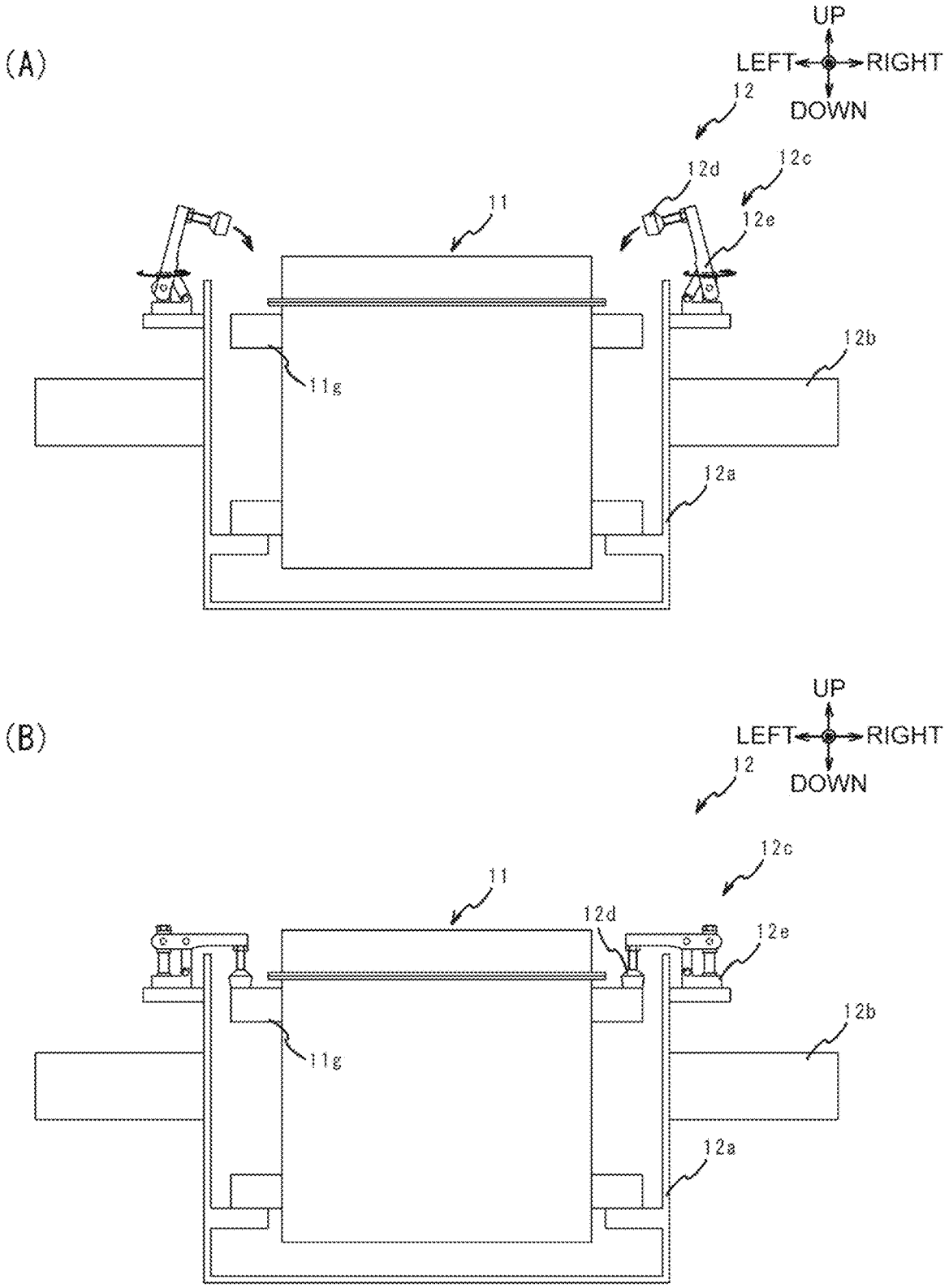
FIG. 3 is a view schematically illustrating a barrel tank case.

Next, the barrel tank case 12 will be described with reference to FIGS. 3(A) and 3(B). The barrel tank case 12 is a member to which the barrel tank 11 is detachably fixed. The barrel tank case 12 includes a frame 12*a*, a rotation shaft 12*b*, and a locking mechanism 12*c*.

The frame 12*a* is a member to accommodate the barrel tank 11, and has a box shape including an open upper surface. The rotation shaft 12*b* extending in the horizontal direction (rightward and leftward direction) is attached to right and left side surfaces of the frame 12*a*. The rotation shaft 12*b* is supported on the turret 13 to be described later.

The locking mechanism 12*c* is provided in an upper portion of the right and left side surfaces of the frame 12*a*. The locking mechanism 12*c* applies a pressing force to the barrel tank 11 accommodated in the frame 12*a*, to thereby fix the barrel tank 11 inside the frame 12*a*. The locking mechanism 12*c* includes a lock member 12*d* and a pressing member 12*e*. In one embodiment, the barrel tank case 12 may include a plurality of the locking mechanisms 12*c*. In the embodiment illustrated in FIG. 3, each of the barrel tank cases 12 includes two lock members 12*d*.

The pressing member 12*e* includes an arm that is rotatable around an axis extending along a frontward and backward direction (direction of the sheet plane of FIG. 3(A)). The lock member 12*d* is attached to a tip of the arm. For example, when a bolt is screwed to rotate an arm of the lock member 12*d* around the axis, as illustrated in FIG. 3(B), the lock member 12*d* is configured to come into contact with a lock portion 11*g* provided in a side wall of the barrel tank body 11*a*. As described above, the lock member 12*d* comes into contact with the lock portion 11*g*, so that the barrel tank 11 is fixed inside the frame 12*a*.

As illustrated in FIG. 1, the pair of turrets 13 are provided on right and left sides of the plurality of barrel tank cases 12. The pair of turrets 13 have a disk shape and are provided to face each other. A through-hole is formed at the center of the plane of each of the turrets 13, and a first bearing 13*a* is provided in the through-hole. The revolution shaft 14 is inserted through the through-holes of the pair of turrets 13 to be fixed to a shaft holder 14*a*. The revolution shaft 14 is rotatably supported on the first bearing 13*a*. Namely, the revolution shaft 14 is supported on the pair of turrets 13 to extend in the horizontal direction.

In addition, a plurality of second bearings 13*b* are provided in each of the turrets 13 at equal intervals along a circumferential direction of the turret 13. Each of the rotation shafts 12*b* of the plurality of barrel tank cases 12 is inserted through the second bearings 13*b*, and the rotation shaft 12*b* is rotatably supported on the second bearings 13*b*. The rotation shafts 12*b* are supported on the pair of turrets 13 to extend in the horizontal direction. As described above, the pair of turrets 13 are disposed to interpose the barrel tank case 12 therebetween via the rotation shaft 12*b* and the second bearings 13*b*, and are fixed to the revolution shaft 14 inserted through the centers of the pair of turrets 13. With this configuration, four barrel tank cases 12 are disposed at equal intervals between the pair of turrets 13, and the four barrel tank cases 12 make a planetary motion around the rotation shafts 12*b* and the revolution shaft 14.

The drive mechanism 15 is connected to the pair of turrets 13. The drive mechanism 15 includes a drive motor 15*a*, a motor pulley 15*b*, a revolution pulley 15*c*, and a drive belt 15*d*. The drive motor 15*a* generates a driving force to rotate the pair of turrets 13. The motor pulley 15*b* is fixed to an output shaft of the drive motor 15*a*. The revolution pulley 15*c* is provided on an outer periphery of one turret 13 (turret 13 on the left side in FIG. 1) of the pair of turrets 13. The drive belt 15*d* is suspended between the motor pulley 15*b* and the revolution pulley 15*c*.

The driven mechanism 16 includes a drive pulley 16*a*, a driven pulley 16*b*, and a driven belt 16*c*. The drive pulley 16*a* is fixed to the revolution shaft 14. The driven pulley 16*b* is fixed to the rotation shaft 12*b*. The driven belt 16*c* is suspended between the drive pulley 16*a* and the driven pulley 16*b*.

In the barrel polishing device 10, when the drive motor 15*a* operates, a driving force is transmitted to the turrets 13 via the motor pulley 15*b*, the drive belt 15*d*, and the revolution pulley 15*c*, so that the turrets 13 rotate around the revolution shaft 14. As the turrets 13 rotate, the barrel tanks 11 fixed to the barrel tank cases 12 turn (revolve) around the revolution shaft 14 as an axial center. In addition, each of the barrel tanks 11 is rotated around the rotation shaft 12*b* as an axial center, in a direction reverse to the rotation direction of the turret 13 by the driven mechanism 16.

As described above, the barrel tank 11 rotates around the rotation shaft 12*b* extending horizontally and revolves around the revolution shaft 14 extending horizontally. Namely, the barrel tank makes a planetary motion around a rotary axis as an axial center extending horizontally.

Next, the washing device 20 of one embodiment will be described with reference to FIGS. 4(A) and 4(B). The washing device 20 illustrated in FIG. 4 includes a casing 21, a washing unit 22, a sorting unit 23, and a rotation mechanism 24.

The casing 21 includes a frame 21*a*, a rotary shaft, a roller 21*c*, and a stopper 21*d*. The frame 21*a* is a container that accommodates the barrel tank body 11*a*, and has a box shape including an open front surface and an open upper surface. The rotary shaft 21*b* is connected to right and left side surfaces of the frame 21*a*. The rotary shaft 21*b* extends from the right and left side surfaces of the frame 21*a* in the horizontal direction. Both end portions of the rotary shaft 21*b* are supported on bearings provided in a support table 21*s*.

A plurality of the rollers 21*c* are provided in a lower portion of the frame 21*a*. As illustrated in FIG. 4(B), the plurality of rollers 21*c* are arranged along the frontward and backward direction. The plurality of rollers 21*c* are connected to a motor (unillustrated) and are configured to be rotatable in a circumferential direction. The motor rotates in a forward direction, so that the barrel tank body 11*a* placed on the rollers 21*c* are transported in the frontward and backward direction. The stopper 21*d* extends upward from a bottom surface of the frame 21*a* to pass through between the plurality of rollers 21*c*. The stopper 21*d* is configured to be extendable and contractible. In a state where the stopper 21*d* extends upward, the stopper 21*d* is in contact with a lower part of the barrel tank body 11*a* to restrict movement of the barrel tank body 11*a* in the frontward and backward direction.

The washing unit 22 includes a frame 22*a*, a screen (second screen) 22*b*, a washing nozzle 22*c*, a distribution pipe 22*d*, and an elevating device 22*e* (nozzle moving mechanism). Incidentally, the washing unit 22 may include a plurality of the washing nozzles 22*c*. In the embodiment illustrated in FIG. 4(A), the washing unit 22 includes four washing nozzles 22*c*.

The frame 22*a* is provided above the frame 21*a*. The frame 22*a* has a plate shape, and an opening having substantially the same shape as that of the opening portion of the barrel tank body 11*a* is formed therein. The distribution pipe 22*d* is fixed to the frame 22*a*. The distribution pipe 22*d* is connected to a washing liquid supply source (for example, a water tap or a pump) that supplies a washing liquid. The distribution pipe 22*d* distributes the washing liquid, which is supplied from the washing liquid supply source, to the washing nozzles 22*c*.

The washing nozzle 22*c* extends in the upward and downward direction above the frame 21*a*. One end (upper end) of the washing nozzle 22*c* is connected to the distribution pipe 22*d*. A plurality of ejection ports (holes) that eject the washing liquid supplied from the distribution pipe 22*d* are formed in a side surface of the washing nozzle 22*c*.

The screen 22*b* (discharge screen) is attached to the openings, which are formed in the frame 22*a* and the distribution pipe 22*d*, to cover the openings. An opening through which the polishing medium and the workpiece are not passable is formed in the screen 22*b*. In one embodiment, a plurality of the openings are formed in the screen 22*b*. As the screen 22*b*, for example, a wire mesh including openings through which the polishing medium and the workpiece are not passable is used. Incidentally, the wire mesh may be a woven wire mesh, a punching metal, or the like, and the form thereof is not particularly limited.

The elevating device 22*e* is connected to the frame 22*a*. The elevating device 22*e* can move the frame 22*a* in the upward and downward direction. When the barrel tank body 11*a* is disposed inside the frame 21*a*, the elevating device 22*e* moves the frame 22*a* in the upward and downward direction, so that the washing nozzles 22*c* can be inserted into and removed from the barrel tank 11 through the opening portion of the barrel tank body 11*a*. In addition, the elevating device 22*e* moves the frame 22*a* in the upward and downward direction, so that the screen 22*b* can be moved between a position where the screen 22*b* covers the opening portion of the barrel tank body 11*a* and a position where the screen 22*b* is separated from the opening portion. In other words, the elevating device 22*e* can attach and detach the screen 22*b* to and from the barrel tank body 11*a*.

The sorting unit 23 includes a frame 23*a*, a screen (first screen) 23*b*, and an elevating device (screen moving mechanism) 23*e*. The frame 23*a* is provided between the washing nozzles 22*c* and the frame 21*a*. The frame 23*a* has a plate shape, and an opening having substantially the same shape as that of the opening portion of the barrel tank body 11*a* is formed in the frame 23*a*.

The screen 23*b* (sorting screen) is attached to the frame 23*a* to cover the opening of the frame 23*a*. Namely, the screen 23*b* has substantially the same planar shape as that of the opening portion of the barrel tank body 11*a*. An opening through which the polishing medium is passable and the workpiece is not passable is formed in the screen 23*b*. In one embodiment, a plurality of the openings are formed in the screen 23*b*. As the screen 23*b*, for example, a wire mesh including openings through which the polishing medium is passable and the workpiece is not passable is used.

The elevating device 23*e* is connected to the frame 23*a*. The elevating device 23*e* can move the frame 23*a* in the upward and downward direction. Therefore, the elevating device 23*e* can move the screen 23*b* between a position where the screen 23*b* covers the opening portion of the barrel tank body 11*a* and a position where the screen 23*b* is separated from the opening portion. In other words, the elevating device 23*e* can attach and detach the screen 23*b* to and from the barrel tank body 11*a*.

The rotation mechanism 24 is connected to the rotary shaft 21*b*. The rotation mechanism 24 includes a rotating motor 24*a* rotatable in forward and reverse directions, a pulley 24*b* fixed to one end of the rotary shaft 21*b*, a pulley 24*c* fixed to an output shaft of the rotating motor 24*a*, and a belt 24*d* suspended between the pulley 24*b* and the pulley 24*c*. When the rotating motor 24*a* operates, a driving force is transmitted to the rotary shaft 21*b* via the pulley 24*b*, the pulley 24*c*, and the belt 24*d*, so that the frame 21*a* rotates around the rotary shaft 21*b*.

Figure 6:
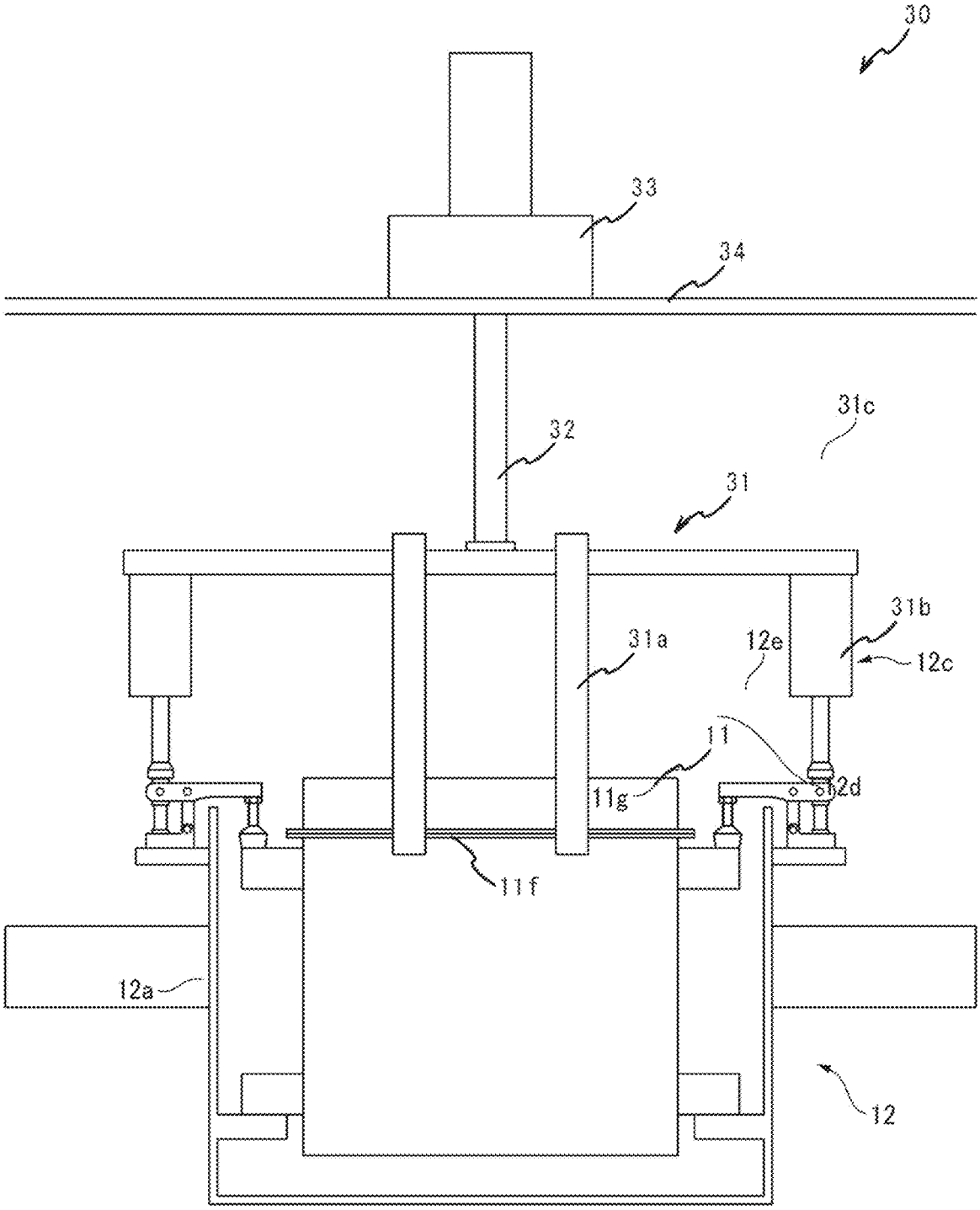
FIG. 6 is a view schematically illustrating a barrel tank attachment and detachment device.

Next, the barrel tank attachment and detachment device 30 will be described with reference to FIG. 6. The barrel tank attachment and detachment device 30 is a device to attach and detach the barrel tank 11 to and from the barrel tank case 12 of the barrel polishing device 10. As illustrated in FIG. 6, the barrel tank attachment and detachment device 30 includes a hanging tool 31, an elevating mechanism 32, a moving mechanism 33, and a rail 34.

The hanging tool 31 includes an arm 31*a*, a clamp mechanism 31*b*, and a frame 31*c*. The frame 31*c* extends in the horizontal direction. The arm 31*a* is hung from the frame 31*c*. An upper end of the arm 31*a* is connected to the frame 31*c*. A lower end of the arm 31*a* is configured to be able to engage with the flange portion 11*f* of the barrel tank 11. In the embodiment illustrated in FIG. 6, two sets of the arms 31*a* are provided, and each set of the arms 31*a* are provided to face each other with the barrel tank 11 interposed therebetween. The barrel tank 11 is held by the arms 31*a*.

The clamp mechanism 31*b* is attached to a lower side of the frame 31*c*. In the embodiment of FIG. 6, two clamp mechanisms 31*b* are provided in the frame 31*c*. The two clamp mechanisms 31*b* are disposed at positions corresponding to the positions of two locking mechanisms 12*c* of the barrel tank case 12. For example, the clamp mechanism 31*b* is configured to rotate the bolt of the locking mechanism 12*c* to thereby be able to change the posture of the arm of the pressing member 12*e*. Accordingly, switching can be performed between a state where the pressing member 12*e* is in contact with the lock portion 11*g* of the barrel tank 11 and a state where the pressing member 12*e* is separated from the lock portion 11*g* of the barrel tank 11. Namely, the clamp mechanism 31*b* can lock the barrel tank 11 to the barrel tank case 12 of the barrel polishing device 10 or release the locking of the barrel tank 11 to the barrel tank case 12.

A lower end of the elevating mechanism 32 is connected to the frame 31*c* of the hanging tool 31. The elevating mechanism 32 includes, for example, a motor and is configured to be able to move the hanging tool 31 in the upward and downward direction using the driving force of the motor. An upper end of the elevating mechanism 32 is connected to the moving mechanism 33. The moving mechanism 33 is provided on the rail 34. The rail 34 is provided above the barrel polishing device 10, the first conveyor C1, and the second conveyor C2. The moving mechanism 33 can move the hanging tool 31 and the elevating mechanism 32 along the rail 34.

As described above, the barrel tank attachment and detachment device 30 can hang the barrel tank 11, for example, which is placed on the second conveyor C2, using the arm 31*a* to transfer the barrel tank 11 to the barrel tank case 12 positioned below the rail 34. On the contrary, the barrel tank attachment and detachment device 30 can hang the barrel tank 11, for example, which is mounted in the barrel tank case 12 positioned below the rail 34, to transfer the barrel tank 11 onto the first conveyor C1.

Incidentally, the barrel tank attachment and detachment device 30 illustrated in FIG. 6 moves the barrel tank 11, which is hung by the hanging tool 31, along the rail 34; however, as long as the barrel tank attachment and detachment device 30 can attach and detach the barrel tank 11 to and from the barrel polishing device 10, the barrel tank attachment and detachment device 30 is not limited to the above-described configuration. For example, the barrel tank attachment and detachment device 30 may include a robot arm capable of holding the barrel tank 11, and attach and detach the barrel tank 11 to and from the barrel polishing device 10 using the robot arm.

Next, the lid attachment and detachment device 40 will be described with reference to FIG. 7. The lid attachment and detachment device 40 is a device to attach and detach the barrel tank lid 11*b* to and from the barrel tank body 11*a*. The lid attachment and detachment device 40 includes a hanging tool 41, an elevating mechanism 42, a moving mechanism 43, and a rail 44. The hanging tool 41 includes an arm 41*a*, a clamp mechanism 41*b*, and a frame 41*c*. The frame 41*c* extends in the horizontal direction. The arm 41*a* is hung from the frame 41*c*. An upper end of the arm 41*a* is connected to the frame 41*c*. A lower end of the arm 41*a* is configured to be able to hold the barrel tank lid 11*b*.

The clamp mechanism 41*b* is attached to a lower side of the frame 41*c*. For example, the clamp mechanism 31*b* rotates the bolt BT of the barrel tank lid 11*b* to thereby fix the barrel tank body 11*a* and the barrel tank lid 11*b* or release the fixing of the barrel tank body 11*a* and the barrel tank lid 11*b*.

A lower end of the elevating mechanism 42 is connected to the hanging tool 41. The elevating mechanism 42 includes, for example, a motor and is configured to be able to move the hanging tool 41 in the upward and downward direction using the driving force of the motor. An upper end of the elevating mechanism 32 is connected to the moving mechanism 43. The moving mechanism 43 is provided on the rail 44. The rail 44 extends to pass above the first conveyor C1, the second conveyor C2, and the lid washing device 90. The moving mechanism 33 can move the hanging tool 41 and the elevating mechanism 42 along the rail 44.

Figure 8:
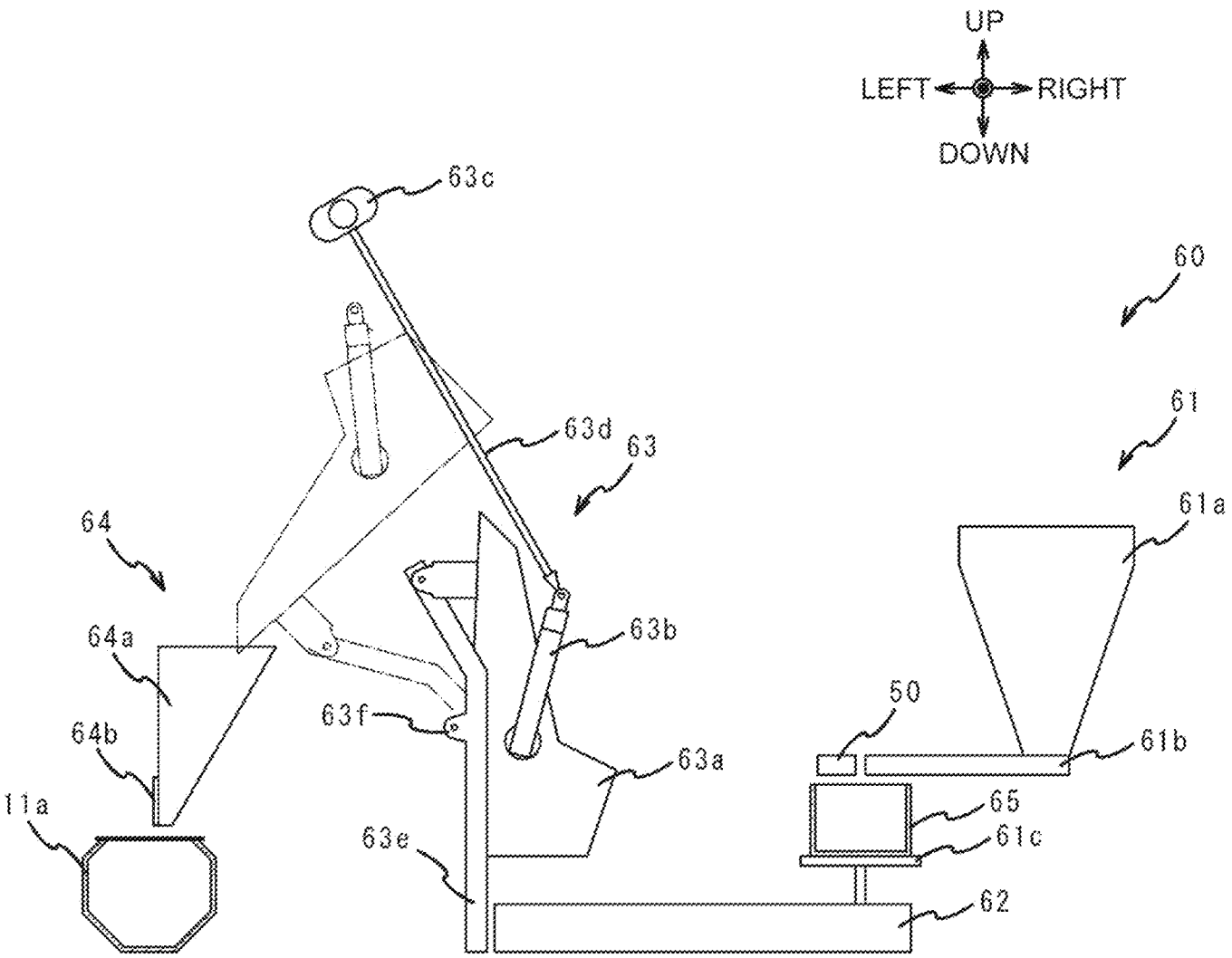
FIG. 8 is a view schematically illustrating a medium charging device.

Next, the medium supply device 60 will be described with reference to FIG. 8. The medium supply device 60 is a device to charge a predetermined amount of polishing medium into the barrel tank body 11*a*. As illustrated in FIG. 8, the medium supply device 60 includes a weighing unit 61, a moving unit 62, a transfer unit 63, and an charging unit 64.

The weighing unit 61 includes a hopper 61*a* to store the polishing medium, a transfer mechanism 61*b* to transfer the polishing medium from the hopper 61*a* to a medium container 65, and a weighing mechanism 61*c* to measure the mass of the polishing medium in the medium container 65. As will be described later, since a non-reusable polishing medium is removed from the polishing medium that is charged into the medium container 65 from a sorting device 50, the amount of polishing medium required for barrel polishing cannot be charged from the sorting device 50. In this case, the transfer mechanism 61*b* is operated to replenish a new polishing medium while measuring the mass of the polishing medium in the medium container 65 using the weighing mechanism 61*c*. When a specified mass is reached, the operation of the transfer mechanism 61*b* is stopped and the charging of the polishing medium is stopped.

The moving unit 62 is configured to be able to move the medium container 65 in the rightward and leftward direction. When the specified amount of polishing medium is charged into the medium container 65, the moving unit 62 sets the medium container 65 in a bucket 63*a* to be described later. In one embodiment, the moving unit 62 may include a fixing mechanism that fixes the medium container 65 to the bucket 63*a*.

The transfer unit 63 includes the bucket 63*a*, a hanger 63*b*, a pulling mechanism 63*c*, a connecting member 63*d*, and a tilting frame 63*e*. The hanger 63*b* is attached to the bucket 63*a*. The connecting member 63*d* connects the hanger 63*b* and the pulling mechanism 63*c*. The tilting frame 63*e* is held to be movable upward and downward along a base and is pivotally supported to be rotatable upward and downward. When the pulling mechanism 63*c* is operated to pull the bucket 63*a*, as illustrated by a two-dot chain line in FIG. 8, the bucket 63*a* is tilted downward around a support member 63*f* as a fulcrum which is attached to the tilting frame 63*e*. Accordingly, the polishing medium accommodated in the medium container 65 is charged into charging hopper 64*a*.

The charging unit 64 includes the charging hopper 64*a* and a gate 64*b* provided in a lower portion of the charging hopper. The gate 64*b* serves as a valve that closes or opens an outlet of the charging hopper 64*a*. When the bucket 63*a* is titled, the polishing medium in the medium container 65 are charged into the charging hopper 64*a*. At this time, an opening portion of the lower portion of the charging hopper 64*a* is closed by the gate 64*b*. When the barrel tank body 11*a* is moved to a predetermined position, the gate 64*b* is opened, and the polishing medium in the charging hopper 64*a* is charged into the barrel tank body 11*a*.

Figure 9:
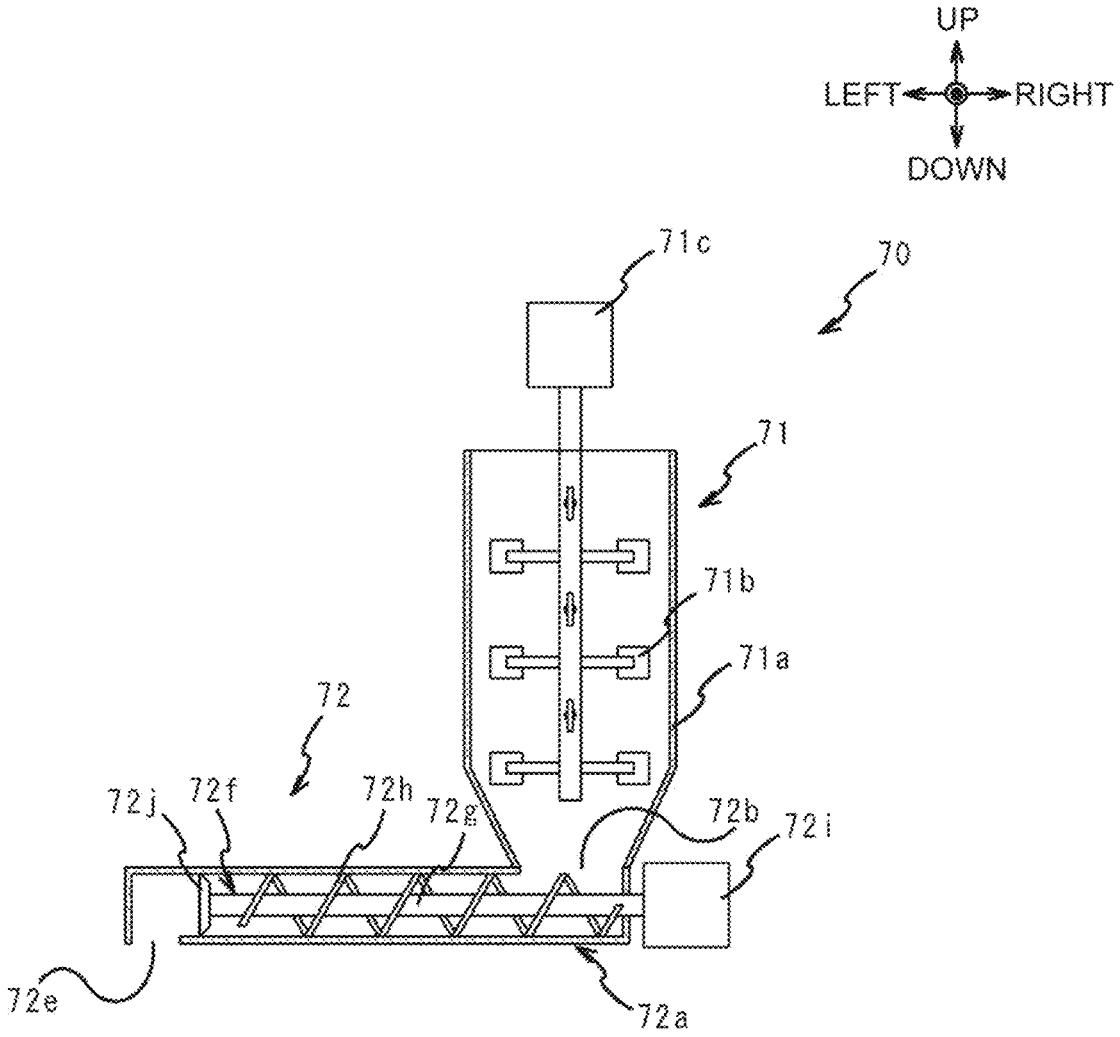
FIG. 9 is a view schematically illustrating an abrasive grain charging device.

Next, the abrasive grain supply device 70 will be described with reference to FIG. 9. As illustrated in FIG. 9, the abrasive grain supply device 70 includes a storage unit 71 and a transport unit 72.

The storage unit 71 includes a hopper 71*a* that temporarily stores abrasive grains, a stirring member 71*b* in which stirring blades are attached to a side portion of a rotary shaft thereof, and a stirring motor 71*c* that is connected to the rotary shaft. When the stirring motor 71*c* operates, the stirring blades of the stirring member 71*b* rotate around the rotary shaft to stir the abrasive grains in the hopper 71*a*. Accordingly, undesired flows such as funnel flows, bridges, and rat holes are prevented from being formed in the hopper 71*a*.

The transport unit 72 includes a trough 72*a* which has a cylindrical shape and of which both end surfaces are closed, a transport screw 72*f* provided in the trough 72*a*, and a transport motor 72*i* connected to the transport screw 72*f*.

An abrasive grain supply port 72*b* is formed on a rear end side (right side in FIG. 9) of the trough 72*a*. The internal space of the trough 72*a* communicates with the internal space of the hopper 71*a* via the abrasive grain supply port 72*b*. An abrasive grain discharge port 72*e* is formed on a front end side (left side in FIG. 9) of the trough 72*a*. The transport screw 72*f* is provided on a rear end side in the trough 72*a*.

The transport screw 72*f* includes a transport shaft 72*g* and a transport blade 72*h*. The transport blade 72*h* is helically fixed to an outer peripheral surface of the transport shaft 72*g*. One end of the transport shaft 72*g* penetrates through a rear end of the trough 72*a* to extend outside the trough 72*a* and is connected to the transport motor 72*i*. The transport motor 72*i* applies a driving force to the transport shaft 72*g* to thereby be able to rotate the transport shaft 72*g* at a random speed. When the transport screw 72*f* rotates around the transport shaft 72*g*, the abrasive grains that are charged into the trough 72*a* from the abrasive grain supply port 72*b* are advanced toward the front end side of the trough 72*a* at a constant speed. Namely, the transport screw 72*f* can advance a target amount of abrasive grains at a constant speed.

A regulating plate 72*j* is disposed between a front end of the transport screw 72*f* and the abrasive grain discharge port 72*e*. A crushing portion through which the abrasive grains are passable is formed in the regulating plate 72*j*. The abrasive grains that have passed through the crushing portion are compressed, and air between the abrasive grains are removed. As a result, the bulk specific gravity of the abrasive grains is increased. In addition, the regulating plate 72*j* crushes the abrasive grains of which the density reaches a predetermined density in front of the regulating plate 72*j* and which turn into a large lump. The abrasive grains that have passed through the crushing portion of the regulating plate 72*j* are advanced toward the front end side of the trough 72*a*, and then are discharged outside the trough 72*a* from the abrasive grain discharge port 72*e*. In the hopper 71*a*, the bulk specific gravity of the abrasive grains varies changed due to the infiltration of gas between the abrasive grains. In addition, the feeding speed of the abrasive grains of the transport screw 72*f* may become non-uniform. On the other hand, since the abrasive grain supply device 70 includes the regulating plate 72*j* described above, it is possible to prevent a variation in the bulk specific gravity of the abrasive grains and the non-uniformity of the feeding speed of the abrasive grains. As a result, it is possible to feed the abrasive grains to the abrasive grain discharge port 72*e* by a constant amount.

The abrasive grain supply device 70 operates the stirring motor 71*c* and the transport motor 72*i* to thereby charge the abrasive grains into the barrel tank body 11*a* disposed below the abrasive grain discharge port 72*e*.

Figure 10:
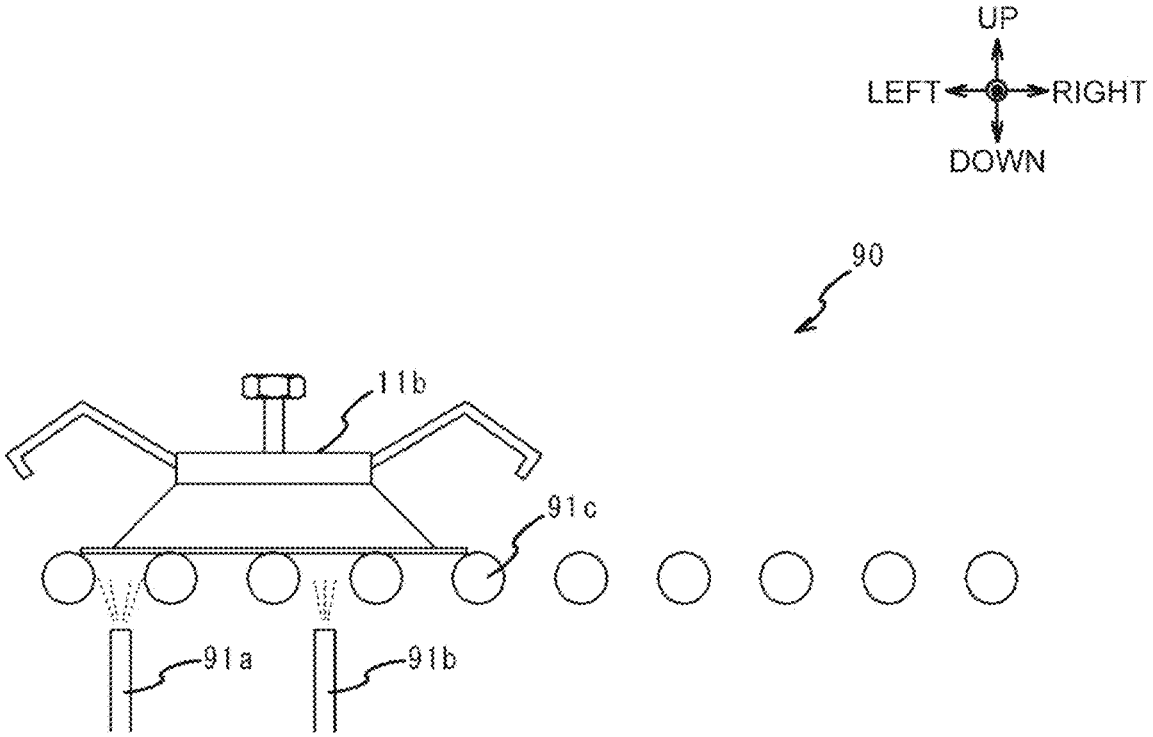
FIG. 10 is a view schematically illustrating a lid washing device.

Next, the lid washing device 90 will be described with reference to FIG. 10. As illustrated in FIG. 10, the lid washing device 90 includes a washing nozzle 91*a*, an air blowing nozzle 91*b*, and a transport unit 91*c*. The transport unit 91*c* is formed of, for example, a plurality of transport rollers.

The washing nozzle 91*a* and the air blowing nozzle 91*b* are provided at positions not to overlap the plurality of transport rollers in a plan view. The washing nozzle 91*a* is provided upstream of the air blowing nozzle 91*b* in a transport direction of the barrel tank lid 11*b*. The washing nozzle 91*a* is connected to a washing liquid supply device which supplies a washing liquid, and ejects the washing liquid from a tip thereof. The air blowing nozzle 91*b* is connected to a compressed air supply device which supplies compressed air, and ejects the compressed air from a tip thereof. The washing nozzle 91*a* and the air blowing nozzle 91*b* extend in the upward and downward direction such that the washing liquid and the compressed air are ejected upward.

The lid washing device 90 ejects washing water to the barrel tank lid 11*b* from the washing nozzle 91*a* to thereby wash the barrel tank lid 11*b*, and ejects the compressed air to the barrel tank lid 11*b* after washing from the air blowing nozzle 91*b* to thereby dry the barrel tank lid 11*b*.

Figure 11:
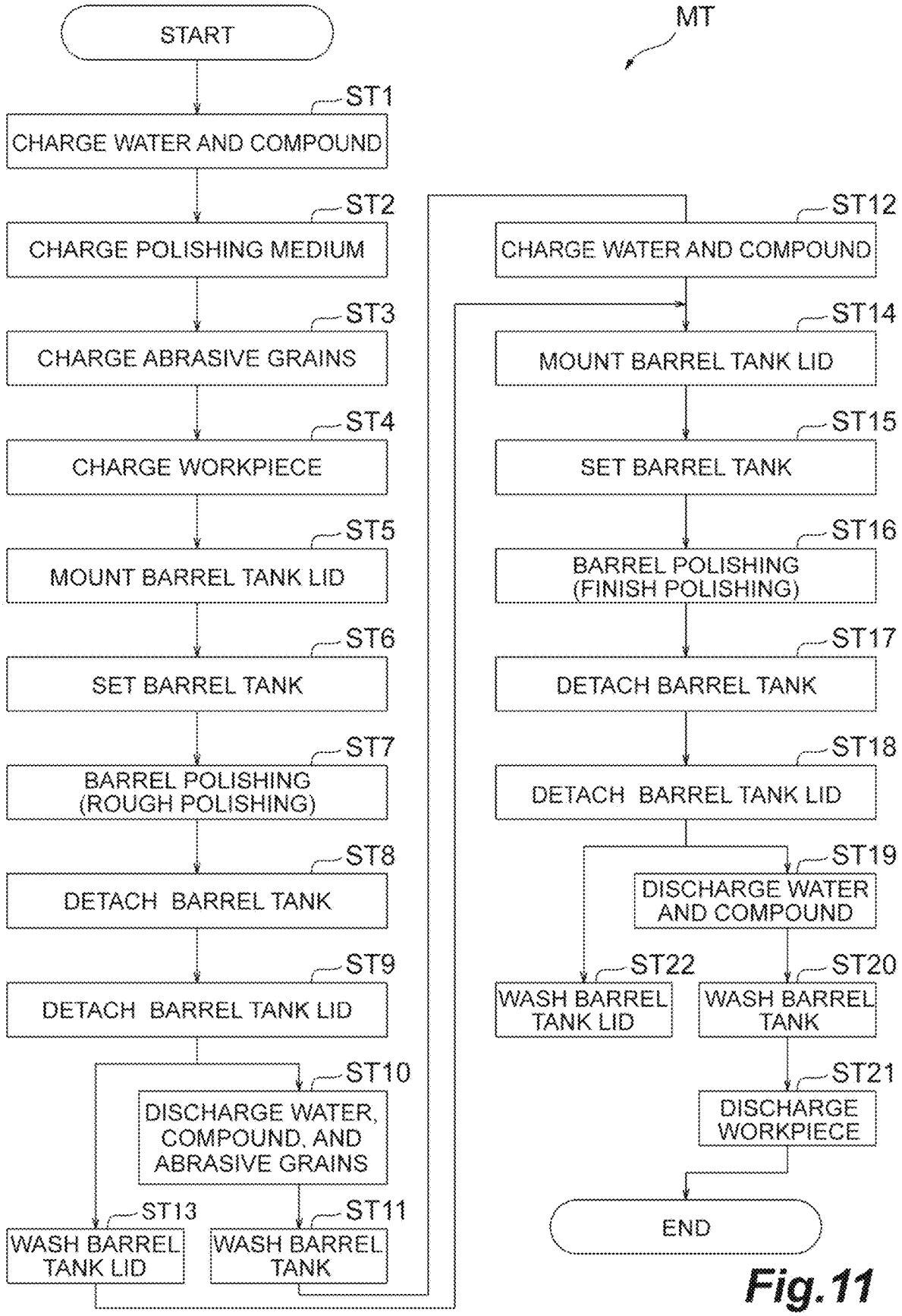
FIG. 11 is a flowchart illustrating a barrel polishing method of one embodiment.

Next, with reference to FIGS. 5 and 11, while the entire configuration of the barrel polishing system will be described, the flow of a series of processes including barrel polishing and washing processes will be described. FIG. 5 is a plan view schematically illustrating the barrel polishing system 1 of one embodiment, and FIG. 11 is a flowchart illustrating a method MT for processing a workpiece according to one embodiment. Hereinafter, a wet barrel polishing system that automatically performs rough polishing and finish polishing on a workpiece will be described.

As illustrated in FIG. 5, the barrel polishing system 1 includes the first conveyor C1 and the second conveyor C2 as the transport device 100. The first conveyor C1 and the second conveyor C2 are chain conveyors that transport the barrel tank 11. Since the chain conveyor can be freely designed according to installation environments (temperature, installation space, and the like), it is possible to realize the barrel polishing system 1 with good workability. Incidentally, if there is no problem with installation, a well-known device such as a belt conveyor or a roller conveyor can be used as the first conveyor C1 and the second conveyor C2.

Incidentally, hereinafter, a description will be given on one barrel tank 11; however, the same processes may be performed on the plurality of barrel tanks 11 mounted in the barrel polishing device 10.

Here, a description will be given starting from a state where the barrel tank body 11*a* that is empty is set in the washing device 20 (washing region E1). In the method MT, first, in step ST1, water and a compound are supplied from the washing device 20 to the barrel tank body 11*a*. Specifically, as illustrated in FIG. 4, the frame 23*a* is lowered by the elevating device 23*e*, and thus the screen 23*b* is moved such that the opening portion of the barrel tank body 11*a* is covered by the screen 23*b*. Next, the frame 22*a* is lowered by the elevating device 22*e*, so that the washing nozzles 22*c* are inserted into the barrel tank body 11*a*. Next, the water and the compound required for rough polishing are supplied from the washing nozzles 22*c*. When the water and the compound are supplied, the screen 23*b* and the washing nozzles 22*c* are separated from the barrel tank body 11*a* by the elevating device 22*e* and the elevating device 23*e*. Next, the fixing of the barrel tank body 11*a* by the stopper 21*d* is released.

Subsequently, in step ST2, the polishing medium is supplied to the barrel tank body 11*a*. Specifically, in step ST2, the motor connected to the rollers 21*c* rotates in the reverse direction to place the barrel tank body 11*a* on the first conveyor C1. Then, the first conveyor C1 is operated to move the barrel tank body 11*a* to a medium charging region E2 (refer to arrow R1).

Next, the polishing medium is supplied from the medium supply device 60 to the barrel tank body 11*a* disposed in the medium charging region E2. Specifically, as illustrated in FIG. 8, the polishing medium in the hopper 61*a* is charged into the medium container 65, and the medium container 65 is set in the bucket 63*a*. Next, the pulling mechanism 63*c* operates to pull the bucket 63*a*, so that the polishing medium accommodated in the medium container 65 is charged into the charging hopper 64*a*. The polishing medium in the charging hopper 64*a* is supplied to the barrel tank body 11*a* disposed in the medium charging region E2.

Subsequently, in step ST3, the abrasive grains are supplied to the barrel tank body 11*a*. Specifically, in step ST3, the barrel tank body 11*a* is moved to an abrasive grain charging region E3 by the second conveyor C2 (refer to arrow R2).

Next, the polishing medium is supplied from the abrasive grain supply device 70 to the barrel tank body 11*a* disposed in the abrasive grain charging region E3. Specifically, as illustrated in FIG. 9, the abrasive grains in the hopper 71*a* are supplied into the trough 72*a*. The abrasive grains in the trough 72*a* are advanced toward the front end side of the trough 72*a* by the rotation of the transport screw 72*f*. The abrasive grains that have reached the regulating plate 72*j* pass through the crushing portion of the regulating plate 72*j* to thereby be crushed. The crushed abrasive grains are charged into the barrel tank body 11*a*, which is disposed in the abrasive grain charging region E3, from the abrasive grain discharge port 72*e*.

Subsequently, in step ST4, the workpiece is supplied to the barrel tank body 11*a*. Specifically, in step ST4, first, the barrel tank body 11*a* is moved to a workpiece charging region E4 by the second conveyor C2 (refer to arrow R3). Incidentally, when the abrasive grains are not used in rough polishing, the barrel tank body 11*a* may be directly moved from the medium charging region E2 to the workpiece charging region E4.

Next, the workpiece is supplied from the workpiece supply device 80 to the barrel tank body 11*a* disposed in the workpiece charging region E4. As the workpiece supply device 80, a well-known device such as a parts feeder, a vibration feeder, or a belt conveyor can be used.

Subsequently, in step ST5, the barrel tank lid 11*b* is mounted on the barrel tank body 11*a*. In step ST5, first, the barrel tank body 11*a* is moved to a lid mounting region E5 by the second conveyor C2 (refer to arrow R4).

Figure 7:
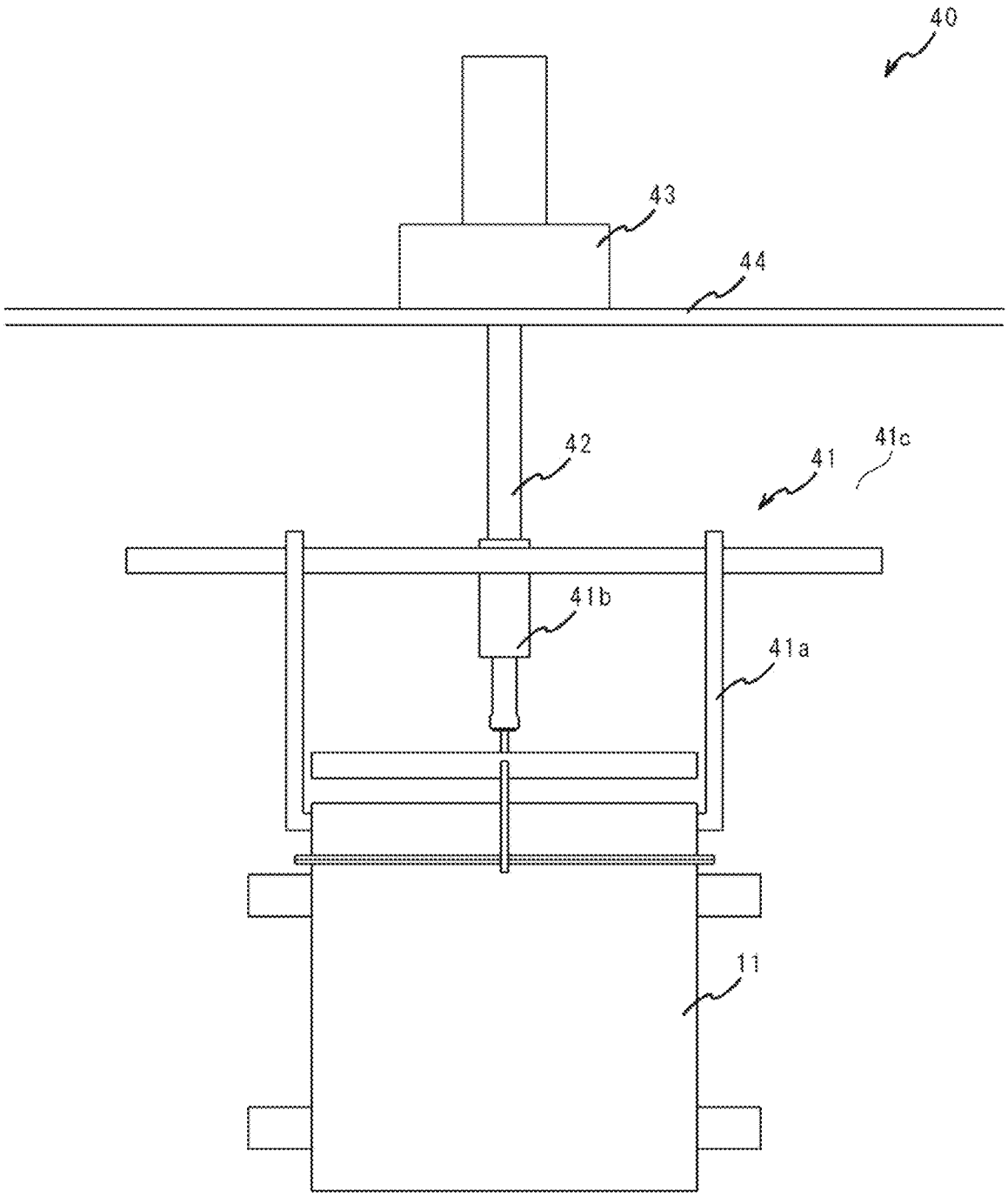
FIG. 7 is a view schematically illustrating a lid attachment and detachment device.

As illustrated in FIG. 7, in step ST5, in a state where the barrel tank lid 11*b* is held by the arm 41*a*, the hanging tool 41 is moved to above the lid mounting region E5 by the moving mechanism 43. Next, the hanging tool 41 is lowered to place the barrel tank lid 11*b* on the barrel tank body 11*a* and the locking of the arm 41*a* and the barrel tank lid 11*b* is released. Next, the barrel tank lid 11*b* is pressed against the barrel tank body 11*a* using the clamp mechanism 41*b*. Accordingly, the barrel tank lid 11*b* is mounted on the barrel tank body 11*a*. When the barrel tank lid 11*b* is mounted on the barrel tank body 11*a*, the hanging tool 41 is retracted upward.

Subsequently, in step ST6, the barrel tank 11 is set in the barrel polishing device 10. In step ST6, first, the barrel tank 11 is moved to a first transfer region E6 by the second conveyor C2 (refer to arrow R5).

Next, as illustrated in FIG. 6, the barrel tank body 11*a* disposed in the first transfer region E6 is mounted in the barrel tank case 12 by the barrel tank attachment and detachment device 30. Specifically, the hanging tool 31 is moved to above the first transfer region E6 by the moving mechanism 33. Next, the hanging tool 31 is lowered by the elevating mechanism 32, and the flange portion 11*f* of the barrel tank 11 is held by a plurality of the arms 31*a*. Next, the hanging tool 31 is raised, so that the barrel tank 11 is hung.

The barrel tank 11 that is hung is moved to a barrel tank attachment and detachment region E7 by the moving mechanism 33 (refer to arrow R6).

At this time, a door provided in a front surface of the barrel polishing device 10 is released, so that the barrel tank case 12 is exposed. Next, the barrel tank 11 is lowered by the elevating mechanism 32 such that the barrel tank 11 is disposed in the barrel tank case 12, and the holding of the arm 31*a* is released. Next, the posture of the pressing member 12*e* is adjusted by the clamp mechanism 31*b* such that the lock member 12*d* and the barrel tank 11 come into contact with each other. Accordingly, the barrel tank 11 is fixed to the barrel tank case 12. Thereafter, the elevating mechanism 32 is operated to retract the hanging tool 31 upward.

Subsequently, in step ST7, barrel polishing is performed. Step ST7 is performed after all the barrel tanks 11 are set in the barrel polishing device 10. In step ST7, the drive motor

15*a* is operated after the door is closed. Accordingly, the barrel tank 11 makes a planetary motion, so that rough polishing is performed.

When the rough polishing is completed after a predetermined time has elapsed, the operation of the drive motor 15*a* is stopped.

Subsequently, in step ST8, the barrel tank 11 is detached from the barrel polishing device 10. In step ST8, first, the door of the barrel polishing device 10 is opened, so that the barrel tank 11 is exposed. Next, after the hanging tool 31 is moved to above the barrel tank attachment and detachment region E7 by the moving mechanism 33, the hanging tool 31 is lowered toward the barrel tank. Then, the pressing of the barrel tank 11 by the lock member 12*d* is released by the clamp mechanism 31*b*. Next, the flange portion 11*f* of the barrel tank 11 is held by the arm 31*a*. Next, the hanging tool 31 is raised by the elevating mechanism 32, so that the barrel tank 11 is detached from the barrel tank case 12.

Next, the barrel tank 11 is moved to above a second placement region E8 by the moving mechanism 33 (refer to arrow R7). Next, after the barrel tank 11 is moved to the first conveyor C1 by the elevating mechanism 32, the holding of the barrel tank 11 by the arm 31*a* is released.

Next, the first conveyor C1 is operated to move the barrel tank 11 to a lid detachment region E9 (refer to arrow R8).

Incidentally, in step ST6 and step ST8, the barrel tank 11 may be attached to and detached from the barrel polishing device 10 using a robot arm. In this case, for example, transport rollers may be disposed between the first transfer region E6 and the second placement region E8, and the barrel tank 11 disposed in the first transfer region E6 may be pushed out to the second placement region E8 by the robot arm using a cylinder.

Subsequently, in step ST9, the barrel tank lid 11*b* is detached from the barrel tank 11 using the lid attachment and detachment device 40. In step ST9, first, the hanging tool 41 is moved to above the lid detachment region E9 by the moving mechanism 43, and the hanging tool 41 is lowered toward the barrel tank. Next, the pressing of the barrel tank lid 11*b* by the lock member 11*d* is released by the clamp mechanism 41*b*. Next, a side surface of the barrel tank lid 11*b* is held by the arm 41*a*. Thereafter, the hanging tool 41 is raised by the elevating mechanism 42, so that the barrel tank lid 11*b* is detached from the barrel tank body 11*a*.

Subsequently, in step ST10, the water, the compound, and the abrasive grains are discharged from the barrel tank body 11*a* using the washing device 20. In step ST10, the first conveyor C1 is operated to move the barrel tank body 11*a* to the washing region E1 (refer to arrow R9). In the process where the barrel tank body 11*a* is transported to the washing region E1, the barrel tank body 11*a* is transferred from the first conveyor C1 onto the plurality of rollers 21*c* of the washing device. As illustrated in FIG. 4, the barrel tank body 11*a* transferred onto the plurality of rollers 21*c* is accommodated in the frame 21*a*, and the movement of the barrel tank body 11*a* is restricted by the stopper 21*d*.

Next, the frame 23*a* is lowered by the elevating device 23*e*, so that the screen 23*b* is set to cover the opening portion of the barrel tank body 11*a*. In addition, the frame 22*a* is lowered by the elevating device 22*e*, so that the screen 22*b* is set to cover the opening portion of the barrel tank body 11*a*, together with the screen 23*b*. Next, the frame 21*a* is rotated around the rotary shaft 21*b* by the driving force of the rotating motor 24*a*, so that the water, the compound, and the abrasive grains are discharged from the opening portion of the barrel tank body 11*a*. At this time, since the opening portion of the barrel tank body 11*a* is covered by the screen 22*b* and the screen 23*b*, the polishing medium and the workpiece after rough processing do not pass through the screen 22*b* and the screen 23*b* to remain in the barrel tank body 11*a*.

Subsequently, in step ST11, the barrel tank body 11*a* is washed using the washing device 20. In step ST11, the frame 21*a* is rotated around the rotary shaft 21*b* again by the driving force of the rotating motor 24*a*, and thus the posture of the barrel tank body 11*a* is adjusted such that the opening portion of the barrel tank body 11*a* faces upward.

Next, washing water (water in one embodiment) from the washing liquid supply source is ejected from the washing nozzles 22*c* toward an inner wall of the barrel tank body 11*a*.

Next, the rotating motor 24*a* is operated to reciprocally rotate, so that the casing 21 oscillates around the rotary shaft 21*b*. At this time, the stopper 21*d*, the washing unit 22, and the sorting unit 23 prevent the barrel tank body 11*a* from being detached from the frame 21*a*.

After the casing 21 oscillates for a predetermined time, the operation of the rotating motor 24*a* is controlled such that the opening portion of the barrel tank body 11*a* faces downward. Since the ejection of the washing water is maintained, the inner wall of the barrel tank body 11*a*, the polishing medium, and the workpiece are washed, and the washing water in the barrel tank body 11*a* is discharged. When the washing of the inner wall of the barrel tank body 11*a* and the polishing medium is completed, the ejection of the washing water is stopped.

Subsequently, in step ST12, the water and the compound are supplied from the washing device 20 to the barrel tank body 11*a*. In step ST12, the posture of the barrel tank body 11*a* is adjusted by the driving force of the rotating motor 24*a* such that the opening portion of the barrel tank body 11*a* faces upward. Next, the water and the compound for finish polishing are supplied from the washing nozzles 22*c*. When the water and the compound are supplied, the screen 23*b* and the washing nozzles 22*c* are separated from the barrel tank body 11*a* by the elevating device 22*e* and the elevating device 23*e*. Next, the fixing of the barrel tank body 11*a* by the stopper 21*d* is released.

In the method MT, step ST13 is performed in parallel with step ST10. In step ST13, the barrel tank lid 11*b* is washed by the lid washing device 90. In step ST13, the barrel tank lid 11*b* detached from the barrel tank body 11*a* in the lid detachment region E9 is moved to a lid washing region E10 by the moving mechanism 43 of the lid attachment and detachment device 40 (refer to arrow R10).

The barrel tank lid 11*b* moved to the lid washing region E10 is placed on the transport unit 91*c* of the lid washing device 90. The barrel tank lid 11*b* is transported in the rightward and leftward direction by the transport rollers of the transport unit 91*c*. In the transport process, the washing water and compressed air are ejected from the washing nozzle 91*a* and the air blowing nozzle 91*b* to the barrel tank lid 11*b*. Accordingly, the barrel tank lid 11*b* is washed and the washing water adhering to the barrel tank lid 11*b* is removed. The barrel tank lid 11*b* that is washed is moved to the lid mounting region E5 by a moving mechanism that is unillustrated. The moving mechanism may be configured to push out the barrel tank lid 11*b* using a cylinder or the like. In addition, a configuration where a motor is connected to the transport rollers and the barrel tank lid 11*b* is moved by the rotation of the rollers may be employed.

Subsequently, in step ST14, the barrel tank body 11*a* is mounted on the barrel tank body 11*a* by the lid attachment and detachment device 40. In step ST14, the barrel tank body 11*a* is moved to the lid mounting region E5 by the first conveyor C1 and the second conveyor C2. Next, the barrel tank lid 11*b* that is washed is hung by the elevating mechanism 42 of the lid attachment and detachment device 40.

The barrel tank lid 11*b* that is hung is moved to above the lid mounting region E5 by the moving mechanism 43 (refer to arrow R11). Next, the barrel tank lid 11*b* is lowered, so that the barrel tank lid 11*b* is mounted on the barrel tank body 11*a*.

Subsequently, in step ST15, the barrel tank 11 is set in the barrel polishing device 10 by the barrel tank attachment and detachment device 30. In step ST15, the second conveyor C2 is operated to move the barrel tank 11 to the first transfer region E6 (refer to arrow R5). Next, the barrel tank 11 is hung by the elevating mechanism 32 to be moved to the barrel tank attachment and detachment region E7 by the moving mechanism 33 (refer to arrow R6). Then, the barrel tank 11 is fixed to the barrel tank case 12. Since the operation of the barrel tank attachment and detachment device 30 in step ST15 is the same as the operation thereof in step ST6, a detailed description will be omitted.

Subsequently, in step ST16, finish polishing is performed by the barrel polishing device 10. When the finish polishing is completed, step ST17 is performed. In step ST17, the barrel tank 11 is detached from the barrel polishing device 10 by the barrel tank attachment and detachment device 30. The barrel tank 11 detached from the barrel polishing device 10 is moved to the second placement region E8.

Subsequently, in step ST18, the barrel tank lid 11*b* is detached from the barrel tank 11 using the lid attachment and detachment device 40. In step ST18, the first conveyor C1 is operated to move the barrel tank 11 to the lid detachment region E9 (refer to arrow R8). Since the operation of the lid attachment and detachment device 40 in step ST18 is the same as the operation of the lid attachment and detachment device 40 in step ST9, a detailed description will be omitted.

Subsequently, in step ST19, the water and the compound are discharged from the barrel tank body 11*a*, from which the barrel tank lid 11*b* has been detached, using the washing device 20. In step ST10, the first conveyor C1 is operated to move the barrel tank body 11*a* to the washing region E1 (refer to arrow R9). Since the operation of the washing device 20 in step ST19 is the same as the operation of the washing device 20 in step ST10, a detailed description will be omitted.

Subsequently, in step ST20, the barrel tank body 11*a* is washed by the washing device 20. As described in step ST11, in step ST20, the washing water is ejected from the washing nozzles 22*c* and the barrel tank body 11*a* oscillates around the rotary shaft 21*b*. Accordingly, the inside of the barrel tank body 11*a*, the polishing medium, and the workpiece are washed. After the washing is completed, the washing nozzles 22*c* are pulled out from the barrel tank body 11*a* by the elevating device 22*e*.

Subsequently, in step ST21, the workpiece is discharged from the barrel tank 11. In step ST21, in a state where the opening portion of the barrel tank body 11*a* is covered by the screen 23*b*, the frame 21*a* is rotated around the rotary shaft 21*b* by the driving force of the rotating motor 24*a*. Accordingly, the washing water and the polishing medium are discharged from the opening portion of the barrel tank body 11*a*. The screen 23*b* is provided with the plurality of openings that are sized to allow the washing water, cutting powder generated by barrel polishing, and the polishing medium to be passable therethrough and the workpiece not to be passable therethrough, and thus the polishing medium and the workpiece can be sorted by the rotation of the casing 21.

Thereafter, the rotating motor 24*a* is operated again to adjust the posture of the casing 21 such that the opening portion of the barrel tank 11 faces upward, and the screen 23*b* is detached from the barrel tank body 11*a* by the elevating device 23*e*. Then, the barrel tank 11 is inverted again, so that the workpiece is discharged from the barrel tank 11.

In the method MT, step ST22 is performed in parallel with step ST19. In step ST22, the barrel tank lid 11*b* is washed by the lid washing device 90. Since the operation of the lid washing device 90 in step S22 is the same as the operation of the lid washing device 90 in step ST13, a detailed description will be omitted.

Incidentally, when a series of barrel polishing is continuously performed, the polishing medium discharged from the barrel tank body 11*a* may be fed to the sorting device 50. The sorting device 50 separates the recovered polishing medium into a reusable polishing medium and a polishing medium of which the size has become unsuitable for barrel polishing due to wear. The reusable polishing medium is fed to the medium supply device 60. The medium supply device 60 replenishes a new polishing medium to adjust the amount of polishing medium to a predetermined amount and to charge the predetermined amount of polishing medium into the barrel tank body 11*a*. Here, the sorting device 50 can use a well-known technique such as a vibrating screen having a predetermined opening.

INDUSTRIAL APPLICABILITY

The washing device of one embodiment facilitates washing of the barrel tank in the centrifugal barrel polishing device to be able to contribute to reducing burden on an operator.

In the barrel polishing paper system according to the above-described embodiment, polishing by the centrifugal barrel polishing device can be automatically performed, thereby contributing to labor saving and a reduction in burden on an operator. More specifically, it is possible to automate operations such as charging and discharging a mass into and from the barrel tank, charging and discharging water and a compound into and from the barrel tank, attaching and detaching the barrel tank to and from the centrifugal barrel polishing device, and washing the barrel tank. Therefore, it is possible to improve the efficiency of a series of processes including barrel polishing.

The washing device and the barrel polishing system according to various embodiments have been described above; however, the present disclosure is not limited to the above-described embodiments, and various modified embodiments can be realized without departing from the concept of the invention. For example, in the above-described embodiments, the configuration where rough polishing and finish polishing are continuously and automatically performed has been described as an example; however, even when the polishing of a workpiece is completed by one cycle of polishing, the barrel polishing system of the above-described embodiment may be used.

Figure 4:
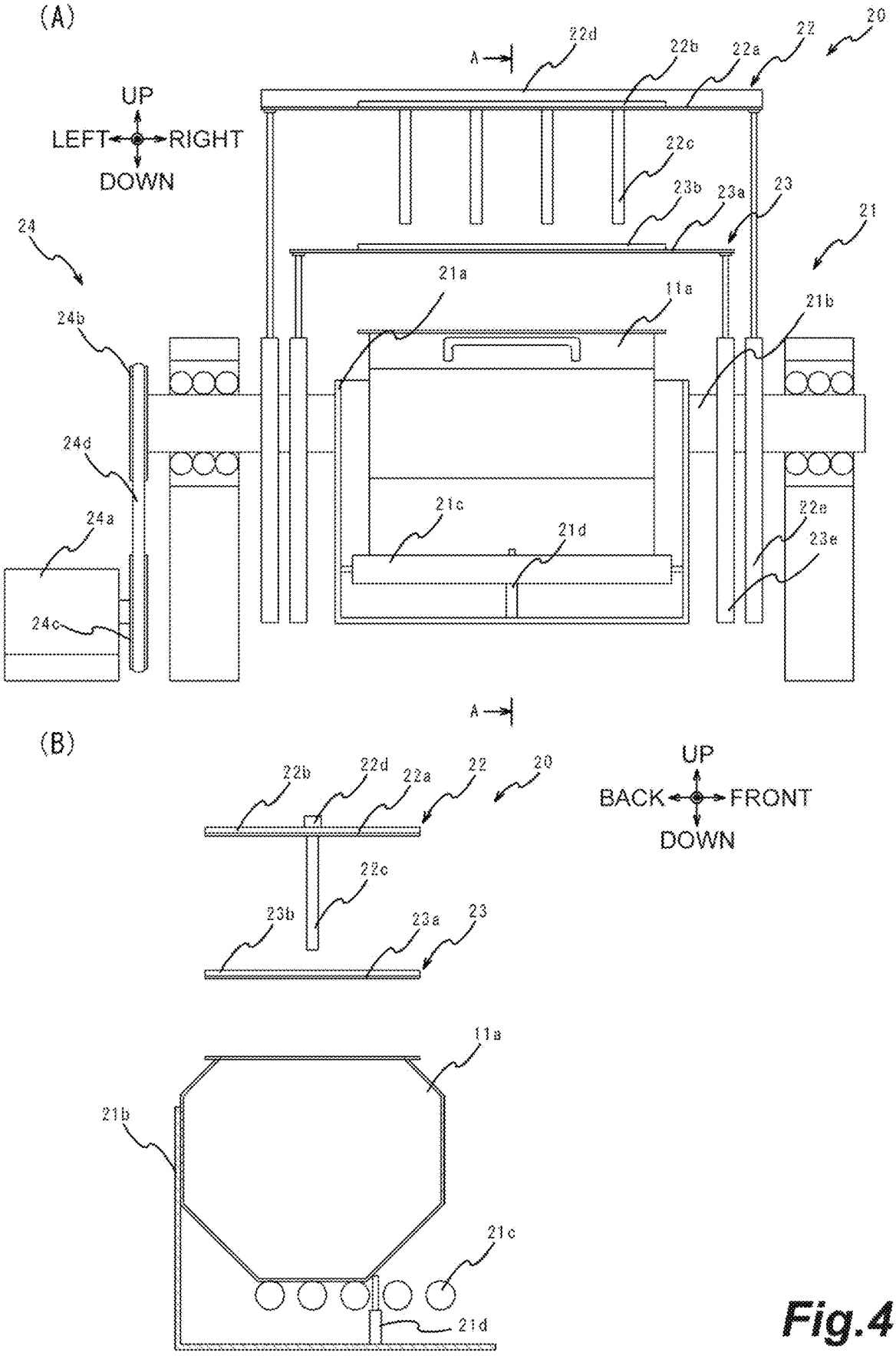
FIG. 4 is a view schematically illustrating a washing device of one embodiment.

In addition, in the embodiment illustrated in FIG. 4, the barrel polishing system 1 includes the medium supply device 60, the abrasive grain supply device 70, and the workpiece supply device 80 as charging devices; however, the barrel polishing system 1 may not include the abrasive grain supply device 70.

REFERENCE SIGNS LIST

1: barrel polishing system, 10: barrel polishing device, 11: barrel tank, 11*a*: barrel tank body, 11*b*: barrel tank lid, 12:

barrel tank case, 12*a*: frame, 12*b*: rotation shaft, 14: revolution shaft, 15: drive mechanism, 20: washing device, 21: casing, 21*a*: frame, 21*b*: rotary shaft, 22*b*: screen (second screen), 22*c*: washing nozzle, 22*e*: elevating device, 23*b*: screen (first screen), 23*e*: elevating device, 24: rotation mechanism, 30: barrel tank attachment and detachment device, 31*a*: arm, 31*b*: clamp mechanism, 32: elevating mechanism, 34: rail, 40: lid attachment and detachment device, 50: sorting device, 60: medium supply device, 70: abrasive grain supply device, 80: workpiece supply device, 90: lid washing device, 100: transport device.

The invention claimed is:

1. A washing device that washes a barrel tank of a horizontal centrifugal barrel polishing device, the device comprising:

a casing including a frame to accommodate the barrel tank, and a rotary shaft extending from the frame in a horizontal direction, wherein the frame is configured to rotate around the rotary shaft;

a washing nozzle configured to eject washing water, wherein the washing nozzle is movable to be inserted into and removed from the barrel tank; and a screen having an opening through which a polishing medium is passable and a workpiece is not passable, wherein the screen is configured to move between a position in which the screen covers an opening portion of the barrel tank and a position in which the screen is separated from the opening portion.

2. The washing device according to claim 1, wherein the screen is a first screen of the washing device, wherein the washing device further comprises a second screen having an opening through which the workpiece and the polishing medium are not passable, and wherein the second screen is configured to move between a position where the second screen covers the opening portion of the barrel tank and a position where the second screen is separated from the opening portion.

3. The washing device according to claim 1, wherein the washing nozzle is configured to supply water and a compound into the barrel tank.

4. A barrel polishing system comprising:

a horizontal centrifugal barrel polishing device that includes a barrel tank case to accommodate a barrel tank, wherein the barrel tank case includes a rotation shaft extending in a horizontal direction to cause the barrel tank to rotate around the rotation shaft, to polish a content of the barrel tank;

a barrel tank attachment and detachment device that includes a holding arm configured to engage with the barrel tank, to attach and detach the barrel tank to and from the barrel tank case of the centrifugal barrel polishing device;

the washing device according to claim 1;

a charging device including a container to charge a mass into the barrel tank; and a conveyor to transport the barrel tank between the centrifugal barrel polishing device, the barrel tank attachment and detachment device, the washing device, and the charging device.

5. The barrel polishing system according to claim 4, wherein the conveyor includes a chain conveyor.

6. The barrel polishing system according to claim 4, wherein the charging device further includes a hopper having an outlet to charge a polishing medium into the barrel tank, a trough having a conveyor screw to charge abrasive grains into the barrel tank, and a workpiece feeder to charge a workpiece into the barrel tank.

7. The barrel polishing system according to claim 4, wherein the barrel tank attachment and detachment device further includes a hanging tool including the holding arm, to hold the barrel tank, and a motor to move the hanging tool upward and downward.

8. The barrel polishing system according to claim 7, wherein the barrel tank attachment and detachment device further includes a clamp actuator extending from a frame of the hanging tool, wherein the clamp actuator has an end opposite to the frame, that is configured to move a locking arm of the barrel tank case, to lock the barrel tank to the centrifugal barrel polishing device or release the barrel tank from the centrifugal barrel polishing device.

9. The barrel polishing system according to claim 4, further comprising:

a lid attachment and detachment device to attach and detach a barrel tank lid to and from a barrel tank body of the barrel tank, wherein the lid attachment and detachment device includes a hanging tool to hold the barrel tank lid, a motor to move the hanging tool upward and downward, and a clamp actuator extending from a frame of the hanging tool, wherein the clamp actuator has an end opposite to the frame, that is configured to operate a fastener to fix the barrel tank lid to the barrel tank body or release the barrel tank lid from the barrel tank body.

10. The barrel polishing system according to claim 9, further comprising:

a lid washing device that washes the barrel tank lid, wherein the lid washing device includes a washing nozzle to eject a washing liquid to the barrel tank lid to wash the barrel tank lid, and an air blowing nozzle to eject compressed air to the barrel tank lid which is washed.

* * * * *